US008215745B2

(12) United States Patent
Ikeda

(10) Patent No.: US 8,215,745 B2
(45) Date of Patent: Jul. 10, 2012

(54) INKJET RECORDING APPARATUS

(75) Inventor: Masami Ikeda, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 166 days.

(21) Appl. No.: 12/841,970

(22) Filed: Jul. 22, 2010

(65) Prior Publication Data

US 2011/0018931 A1 Jan. 27, 2011

(30) Foreign Application Priority Data

Jul. 24, 2009 (JP) ..... 2009-172895

(51) Int. Cl.
*B41J 2/165* (2006.01)

(52) U.S. Cl. ..... 347/29

(58) Field of Classification Search ..... 347/29, 347/30, 22, 36
See application file for complete search history.

(56) References Cited

U.S. PATENT DOCUMENTS 7,806,506 B2 * 10/2010 Umeda ..... 347/29
7,905,571 B2 * 3/2011 Byun ..... 347/36

FOREIGN PATENT DOCUMENTS

JP 2009-66909 4/2009

* cited by examiner

*Primary Examiner* — Lamson Nguyen
(74) *Attorney, Agent, or Firm* — Knobbe, Martens, Olson & Bear, LLP

(57) ABSTRACT

An inkjet recording apparatus is provided, which includes a plurality of recording heads, a cap unit, waste ink container and communicating member. Each recording head includes a nozzle face with inkjet nozzles. The cap unit includes a plurality of first ink receiving members and a second ink receiving member. Each first ink receiving member is disposed below and corresponding to each recording head and has a first receiving portion receiving ink discharged from the inkjet nozzles and a first discharging hole discharging the received ink. The second ink receiving member is disposed below and corresponding to the first ink receiving members and has a second receiving portion that collectively receives the ink discharged through a plurality of first discharging holes and a second discharging hole. The communicating member connects the second discharging hole with an ink storage chamber of the waste ink container.

16 Claims, 21 Drawing Sheets

INKJET RECORDING APPARATUS

This application is based on and claims the benefit of priority from Japanese Patent Application No. 2009-172895, filed on 24 Jul. 2009, the content of which is incorporated herein by reference.

BACKGROUND OF INVENTION

1. Field of the Invention

The present disclosure relates to an inkjet recording apparatus that records information on a recording medium such as paper by ink ejected through a nozzle.

2. Related Art

An inkjet recording apparatus is generally provided with: a plurality of recording heads each including a nozzle face on which thousands of inkjet nozzles are formed; a plurality of nozzle cap members that can be disposed below and corresponding to each of the plurality of recording heads; a waste ink container for storing discarded ink; and communicating members such as tubes that communicatively connect the nozzle cap members with the waste ink container.

A nozzle cap member covers the nozzle face when a recording head is not in use. By covering the nozzle face with the nozzle cap member when the recording head is not in use, it is possible to prevent a nozzle from clogging due to dried ink and a foreign matter from intruding into the recording head via the nozzle.

The nozzle cap member collects ink discharged from the nozzles. Discharging of ink (so-called ejection recovery processing (purge)) is performed especially at a start of recording (printing). This may prevent use of ink in image formation, the viscosity of which may be high as a result of staying in the nozzles and the like. After the ejection recovery processing, a substantial amount of ink discharged from the nozzles is collected in the nozzle cap member. The ink collected in the nozzle cap member is fed to be stored in the waste ink container, for example by a suction force of a pump or the like, via the communicating members.

In addition, an inkjet recording apparatus is generally provided with a plurality of recording heads. For example, a color inkjet recording apparatus, which has three recording heads for each of four colors, it will have 12 recording heads. Furthermore, since a nozzle cap member is required for each of the recording heads, the inkjet recording apparatus is provided with 12 nozzle cap members. Moreover, since a communicating member is connected to each of the nozzle cap members, the same number of communicating members as the nozzle cap members, in other words 12 communicating members, are required.

SUMMARY OF THE INVENTION

As described above, the inkjet recording apparatus tends to be constructed such that a large number of communicating members are disposed below the nozzle cap members. This may result in a problem of a complex arrangement of the communicating members and a restriction in the configuration of a moving mechanism of the nozzle cap members and the like.

The same problem may occur also in an inkjet recording apparatus provided with a first ink receiving member instead of the nozzle cap member. The first ink receiving member that does not completely cover the nozzle face receives ink discharged from the nozzles.

The present disclosure provides an inkjet recording apparatus including a plurality of recording heads, a plurality of first ink receiving members provided corresponding to the plurality of recording heads respectively, waste ink containers and communicating members that provide paths to guide ink to the waste ink containers. The inkjet recording apparatus can reduce the number of communicating numbers and simplify the arrangement of the communicating members.

The present disclosure relates to an inkjet recording apparatus that includes a plurality of recording heads, cap units, waste ink containers and communicating members. Each of the recording heads includes a nozzle face on which inkjet nozzles are formed. Each of the cap units includes a plurality of first ink receiving members and a second ink receiving member. Each of the first ink receiving members is disposed below and corresponding to each of the recording heads and has a first receiving portion that receives ink discharged from the inkjet nozzles and a first discharging hole that discharges the ink received by the first receiving portion. The second ink receiving member is disposed below and corresponding to the first ink receiving members and has a second receiving portion that collectively receives the ink discharged through a plurality of first discharging holes and a second discharging hole that discharges the ink received by the second receiving portion. Each of the waste ink containers includes an ink storage chamber storing ink. Each of the communicating members communicatively connects the second discharging hole of the second ink receiving member with the ink storage chamber of each of the waste ink containers.

DETAILED DESCRIPTION OF THE INVENTION

First Embodiment

A first embodiment of the present disclosure is described hereinafter with reference to the drawings.

An overview of overall structure of an inkjet recording apparatus 1 according to the first embodiment is described with reference to FIGS. 1 to 8.

Figure 1:
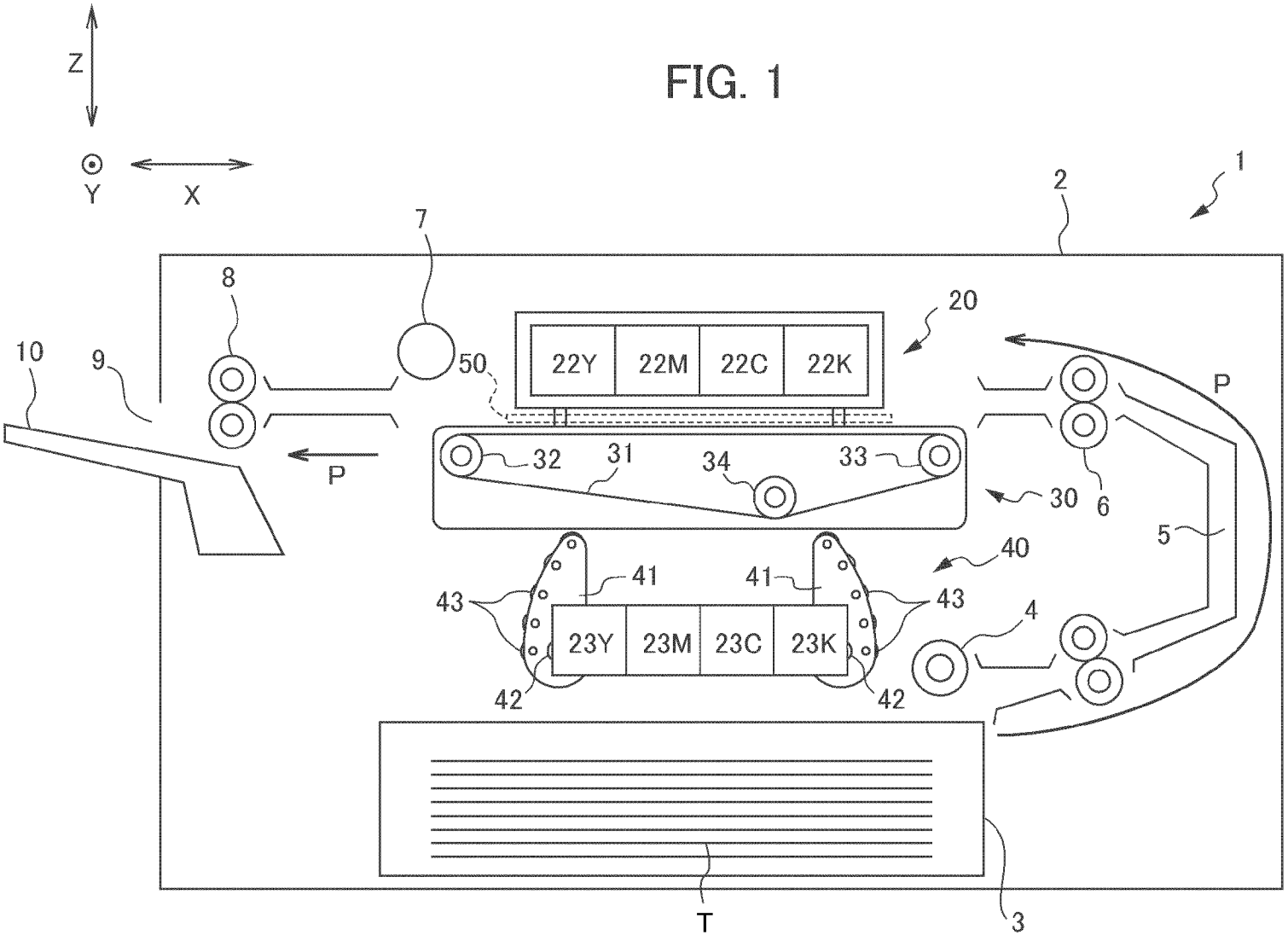
FIG. 1 is a vertical cross-sectional view schematically showing an overview of an inkjet recording apparatus according to a first embodiment from a front side.
Figure 2A:
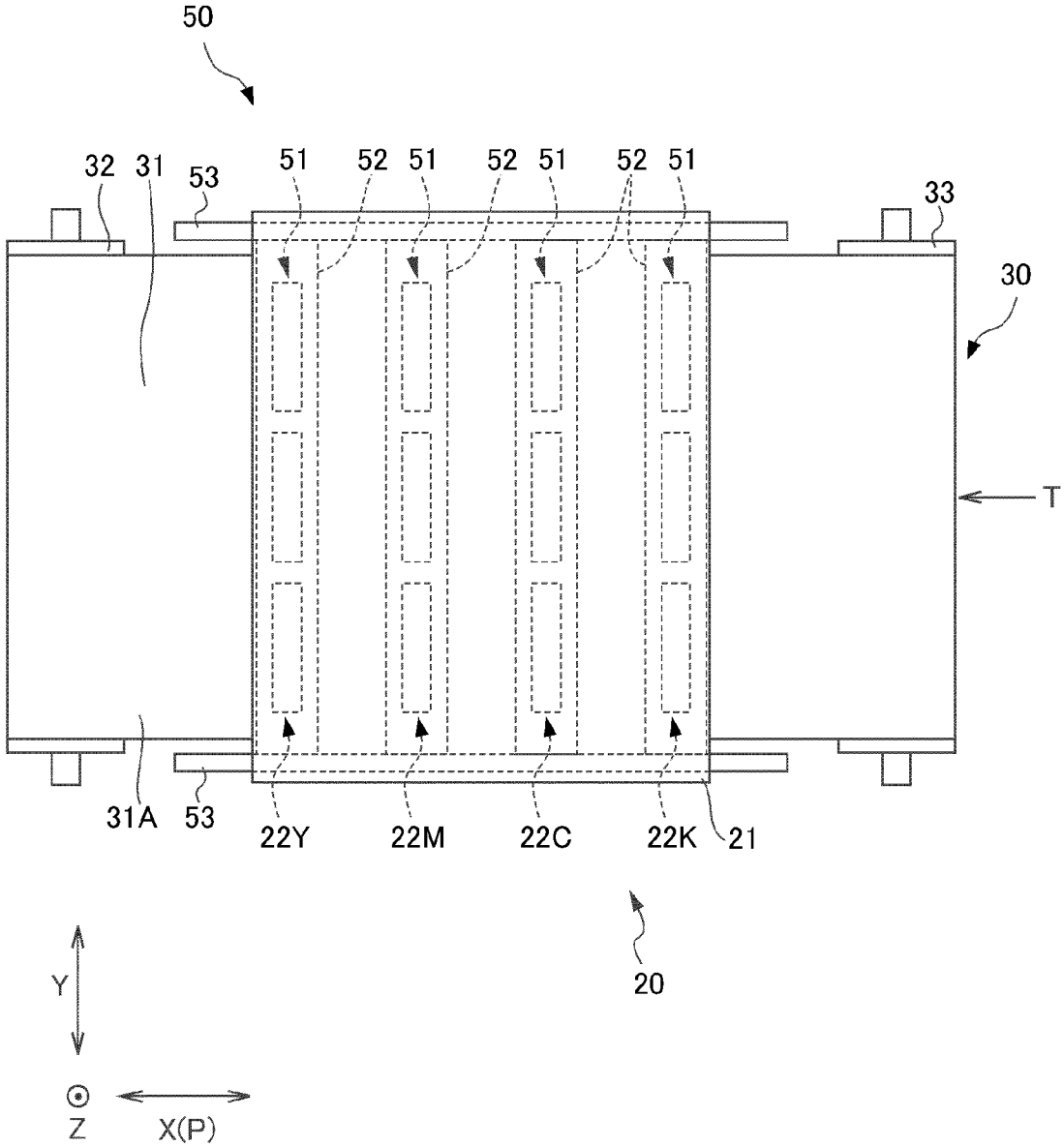
FIG. 2A is a plan view showing a periphery of a recording unit and a conveyance unit while a cap unit is attached to recording heads in the inkjet recording apparatus according to the first embodiment.
Figure 2B:
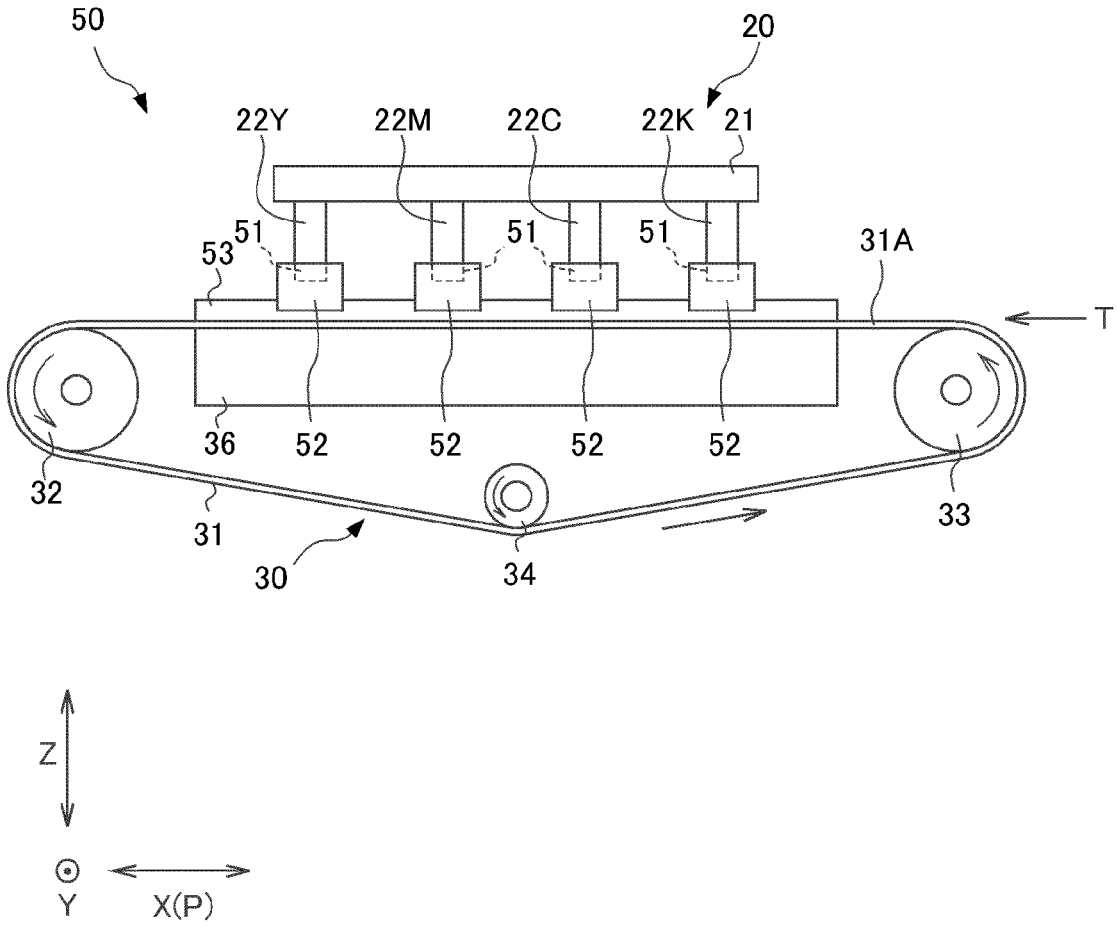
FIG. 2B is a front view showing a periphery of the recording unit and the conveyance unit while the cap unit is attached to the recording heads in the inkjet recording apparatus according to the first embodiment.

FIG. 1 is a vertical cross-sectional view schematically showing an overview of the inkjet recording apparatus 1 according to a first embodiment from a front side. FIG. 2A is a plan view showing a periphery of a recording unit 20 and a conveyance unit 30 while a cap unit 50 is attached to the recording heads 22 in the inkjet recording apparatus 1 according to the first embodiment. FIG. 2B is a front view showing a periphery of the recording unit 20 and the conveyance unit 30 while the cap unit 50 is attached to the recording heads 22 in the inkjet recording apparatus 1 according to the first embodiment.

Figure 3A:
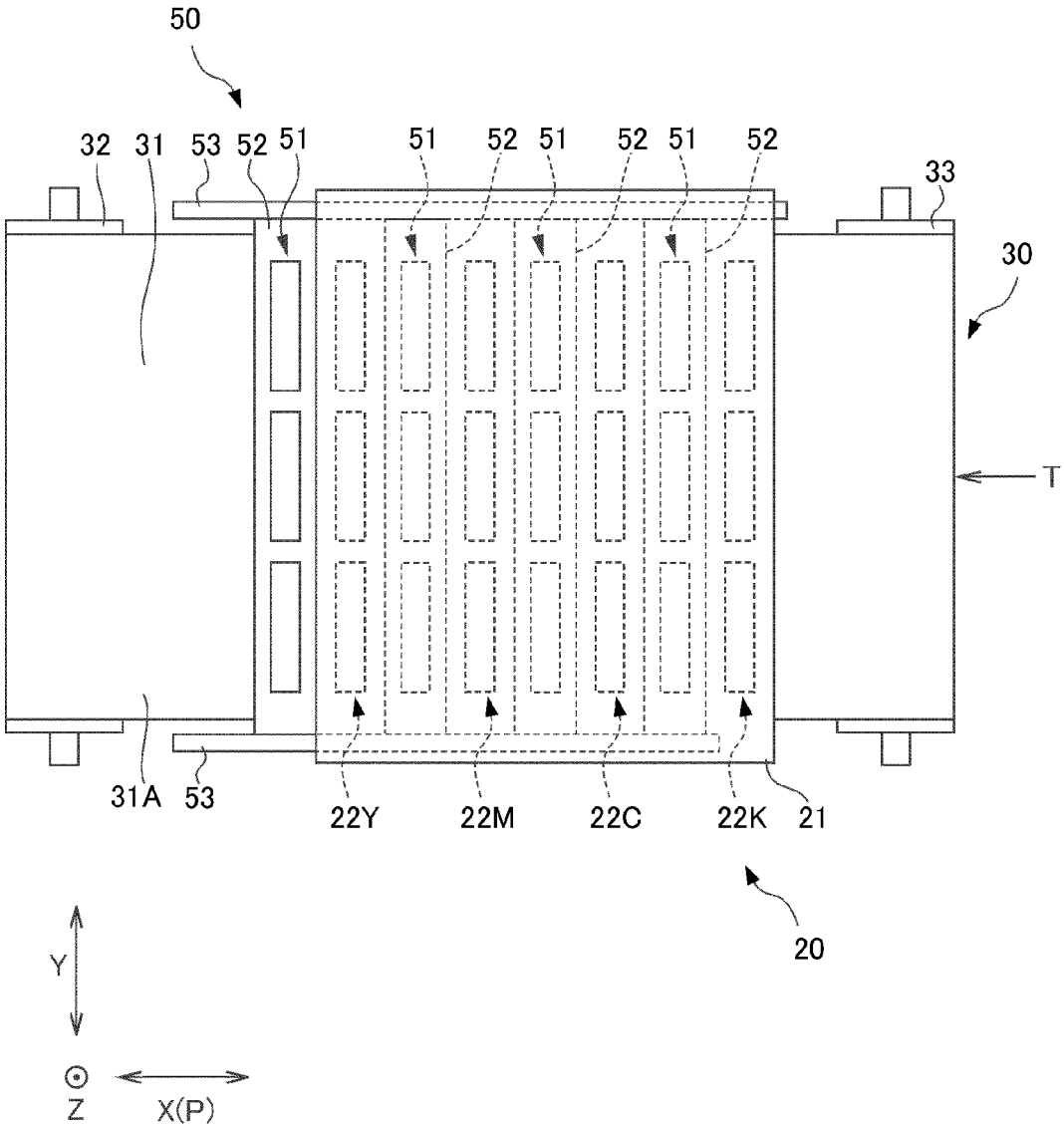
FIG. 3A is a plan view showing the periphery of the recording unit and the conveyance unit when the recording heads are ready to print (record), in the inkjet recording apparatus according to the first embodiment.
Figure 3B:
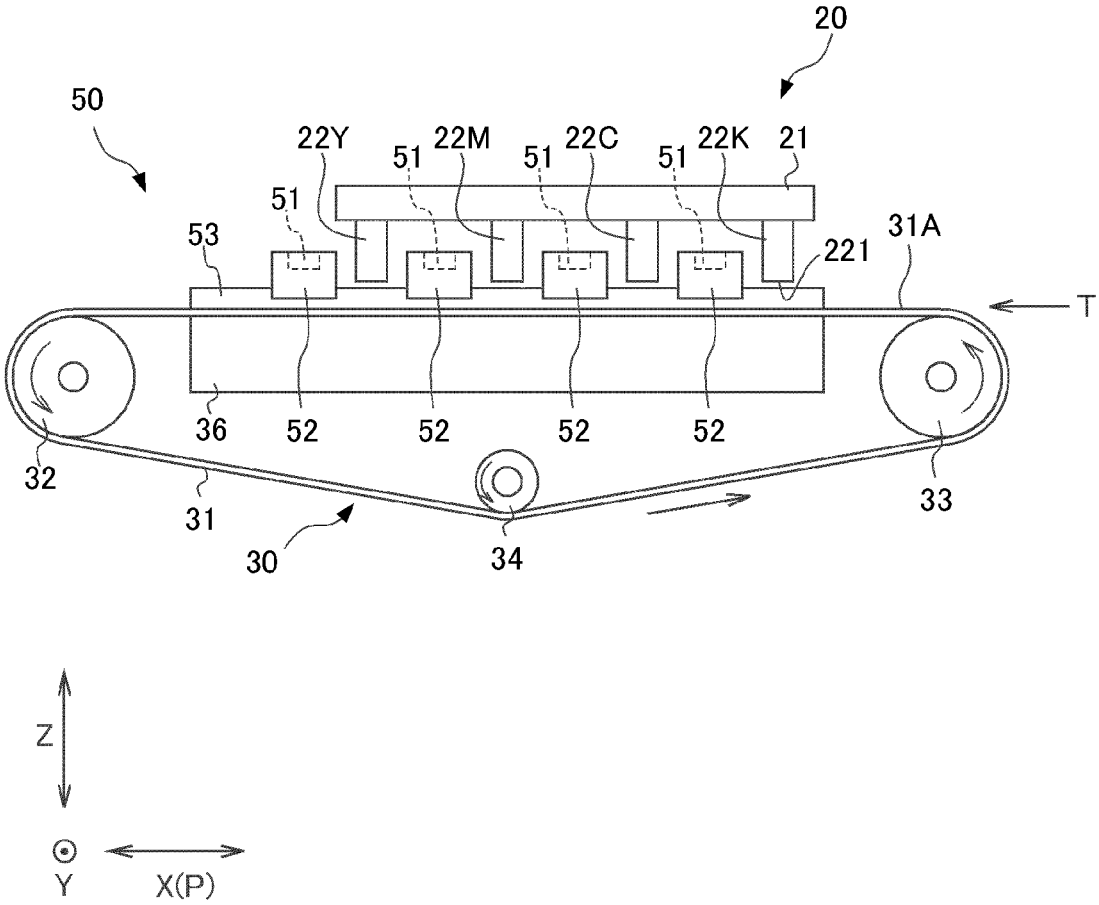
FIG. 3B is a front view showing the periphery of the recording unit and the conveyance unit when the recording heads are ready to record, in the inkjet recording apparatus according to the first embodiment.
Figure 4A:
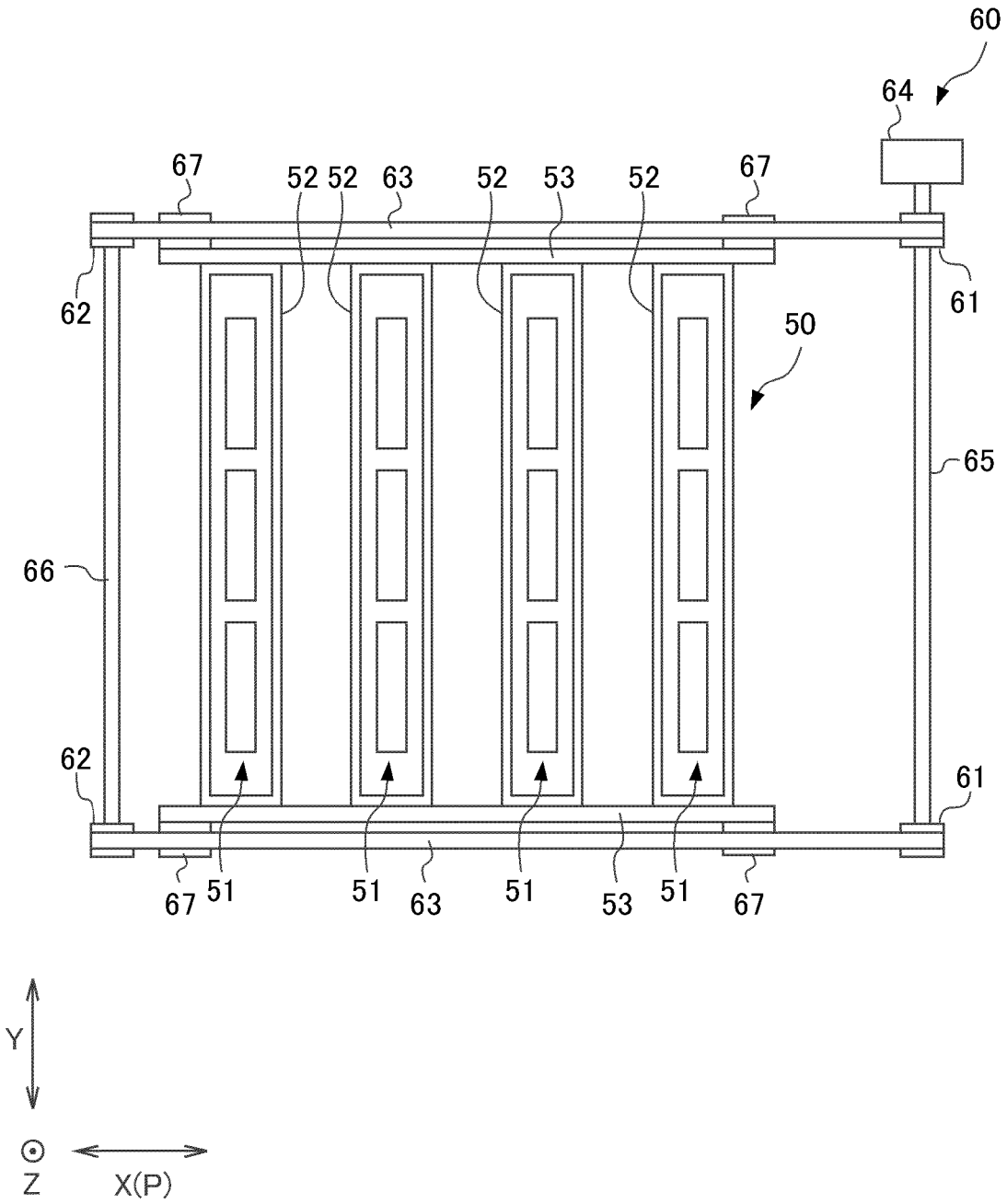
FIG. 4A is a plan view showing a cap unit and a horizontal movement mechanism in the inkjet recording apparatus according to the first embodiment.
Figure 4B:
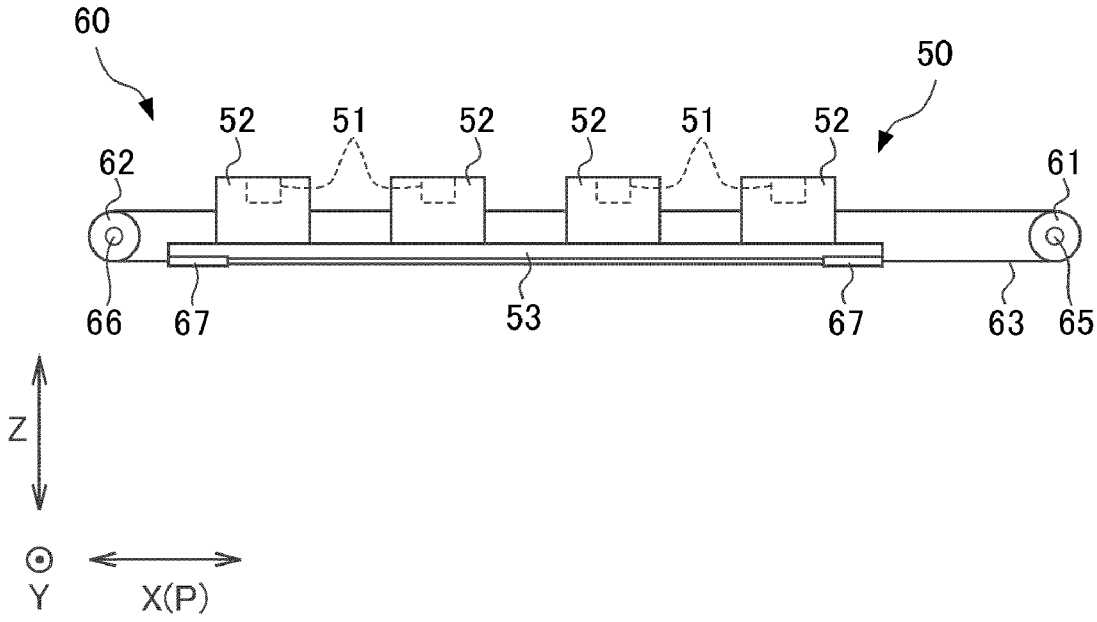
FIG. 4B is a front view showing the cap unit and the horizontal movement mechanism in the inkjet recording apparatus according to the first embodiment.

FIG. 3A is a plan view showing the periphery of the recording unit 20 and the conveyance unit 30 when the recording heads 22 are ready to print (record), in the inkjet recording apparatus 1 according to the first embodiment. FIG. 3B is a front view showing the periphery of the recording unit 20 and the conveyance unit 30 when the recording heads 22 are ready to record, in the inkjet recording apparatus 1 according to the first embodiment. FIG. 4A is a plan view showing the cap unit 50 and a horizontal movement mechanism 60 in the inkjet recording apparatus 1 according to the first embodiment. FIG. 4B is a front view showing the cap unit 50 and the horizontal movement mechanism 60 in the inkjet recording apparatus 1 according to the first embodiment.

Figure 5:
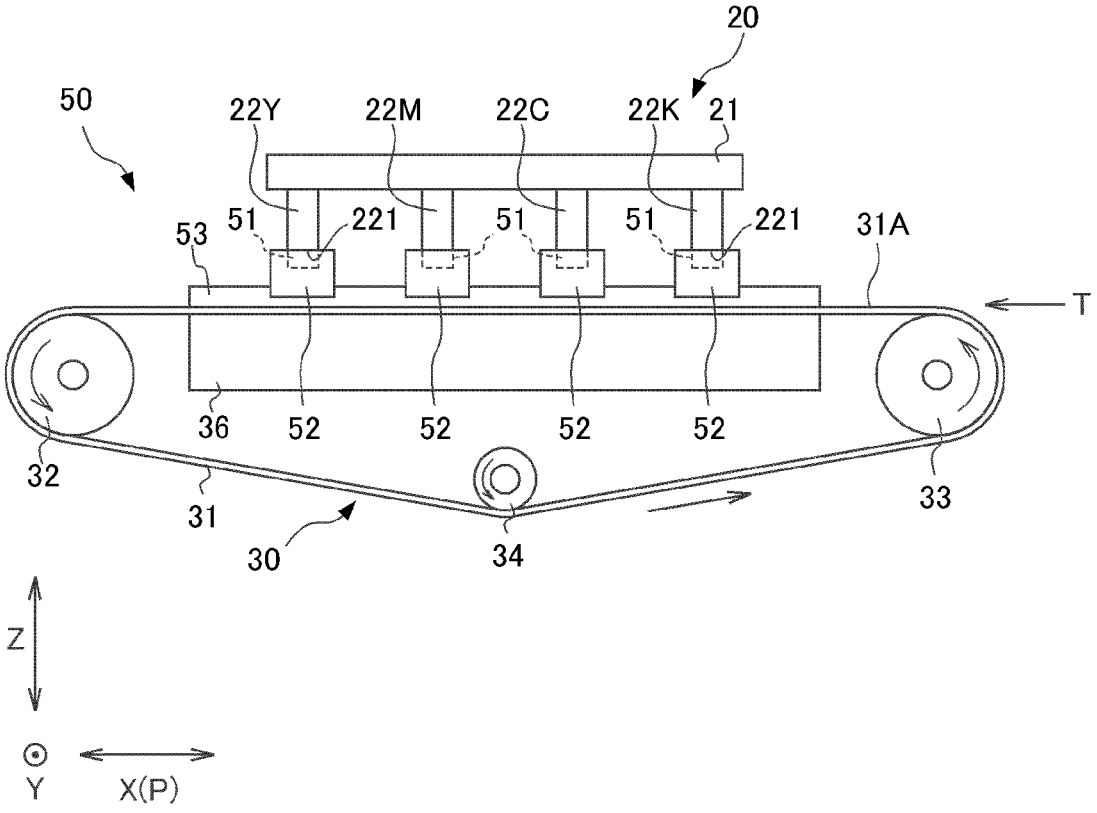
FIG. 5 is a front view showing the cap unit being attached to the recording heads at an attachment/detachment position.
Figure 6:
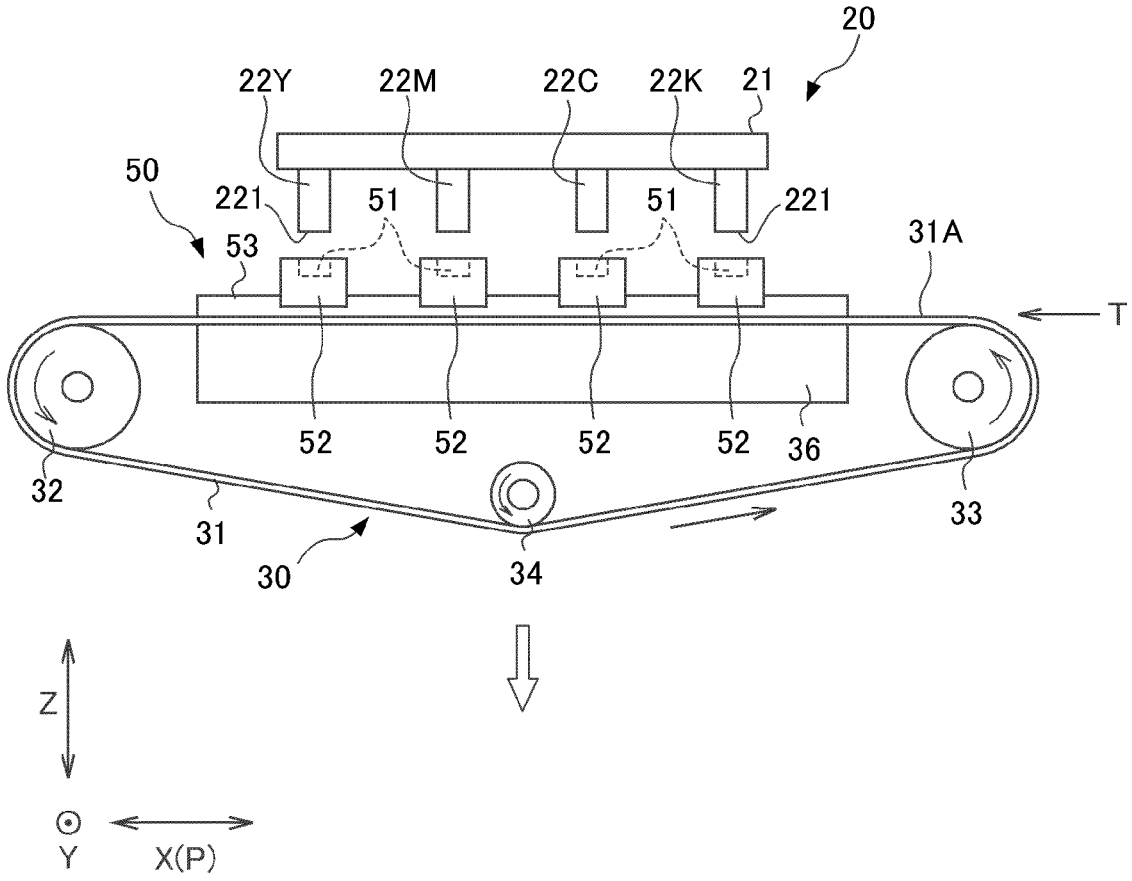
FIG. 6 is a front view showing the cap unit having been moved downward from the attached state at the attachment/detachment position.
Figure 7:
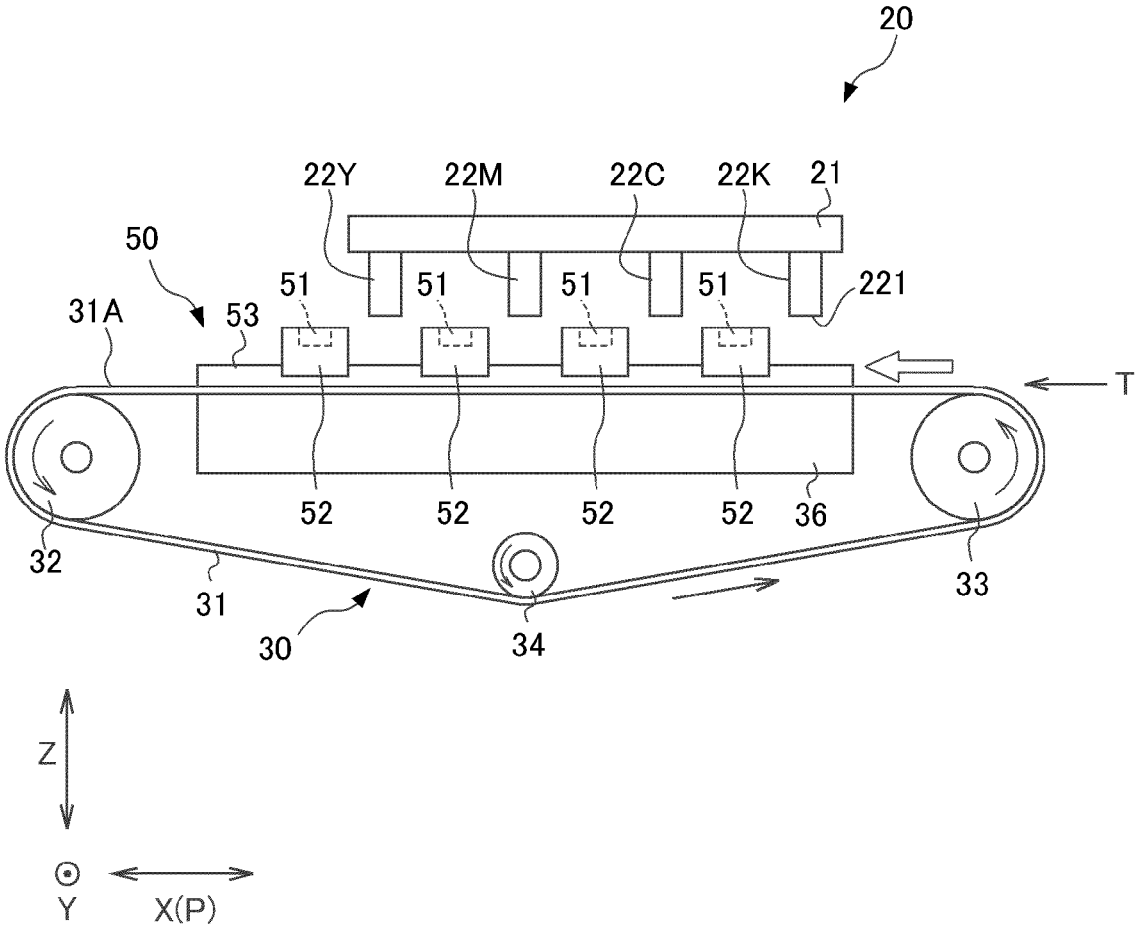
FIG. 7 is a front view showing the cap unit having been moved to waiting position from the attachment/detachment position.
Figure 8:
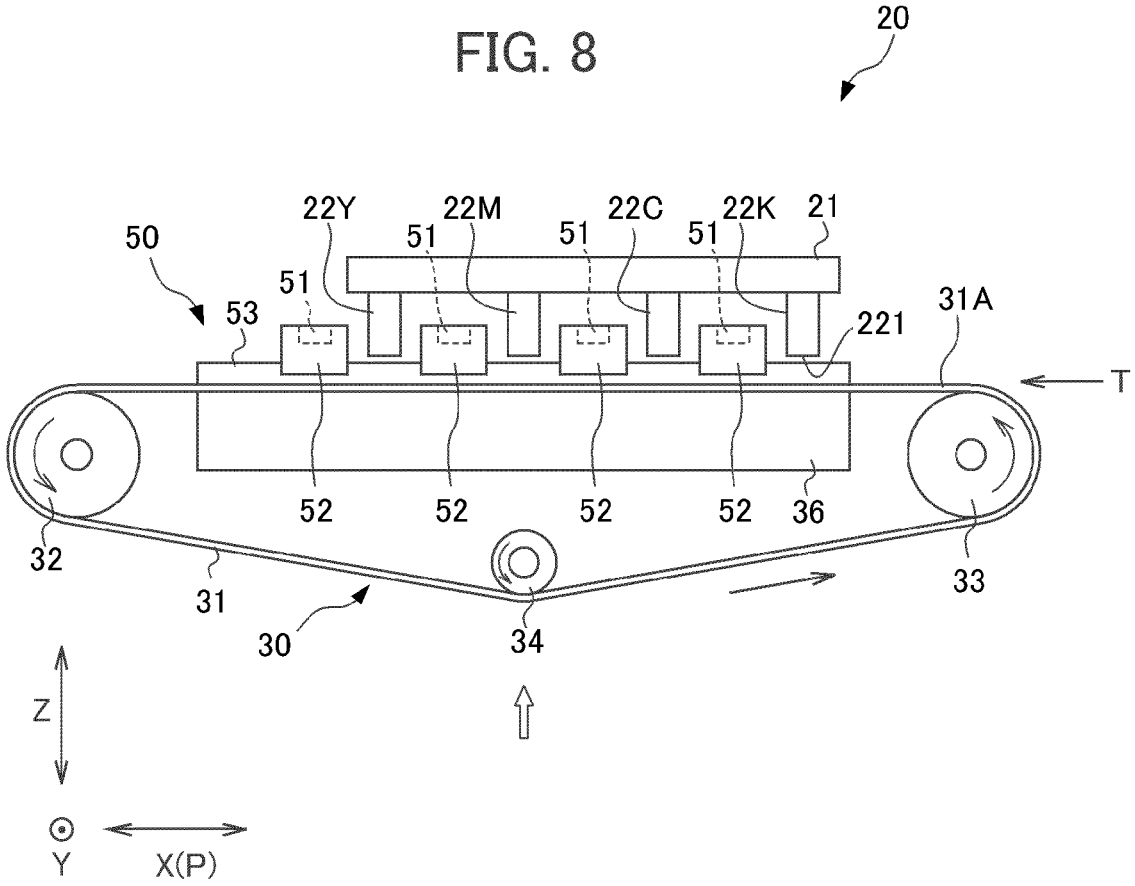
FIG. 8 is a front view showing the recording heads ready to record (print)

FIG. 5 is a front view showing the cap unit 50 being attached to the recording heads 22 at an attachment/detachment position. FIG. 6 is a front view showing the cap unit 50 having been moved downward from the attached state at the attachment/detachment position. FIG. 7 is a front view showing the cap unit 50 having been moved to a waiting position from the attachment/detachment position. FIG. 8 is a front view showing the recording heads 22 ready to record (print).

As shown in FIGS. 1 to 3B, the inkjet recording apparatus 1 according to the first embodiment includes inside a main body 2: the recording unit 20; the conveyance unit 30; a vertical movement device 40 for the conveyance unit 30; the cap unit 50; and the horizontal movement mechanism 60 (see FIGS. 4A and 4B).

The inkjet recording apparatus 1 according to the first embodiment further includes: a paper feeding cassette 3; a paper feeding roller 4; a paper conveying path 5; a resist roller pair 6; a drying device 7; a paper discharging roller pair 8; a paper discharging opening 9; and a discharged paper tray 10.

As shown in FIGS. 1 to 3B, the conveyance unit 30 has a drive roller 32, a driven roller 33, a tension roller 34, a conveyor belt 31 that is wound on the drive roller 32, the driven roller 33 and the tension roller 34, and an air suction unit 36. The tension roller 34 adjusts tension of the conveyor belt 31. On the conveyor belt 31 and an upper face of the air suction unit 36, a large number of through holes (not shown) for sucking air are provided.

A portion of the conveyor belt 31 facing the recording unit 20 is defined as a conveyance face 31A. With the counter-clockwise rotation of the drive roller 32 and the driven roller 33 as viewed in front of them, the conveyance face 31A is horizontally moved in a paper conveying direction P on a horizontal plane (X-Y plane). In other words, since paper T as a recording medium is conveyed while being suctioned onto the conveyance face 31A of the conveyor belt 31, the paper conveying direction P substantially agrees with a horizontal direction X. The air suction unit 36 is disposed below (opposite to) the conveyance face 31A of the conveyor belt 31.

As the conveyor belt 31, a seamless belt and the like may be used.

As shown in FIGS. 2A to 3B, when recording is being performed, the paper T as a recording medium is introduced to the conveyance face 31A of the conveyor belt 31 from one side of the paper conveying direction P. A suction force for suctioning the paper to the conveyance face 31A generated by the air suction unit 36 is applied to the conveyance face 31A via the through holes for suction (not shown). The paper T introduced to the conveyance face 31A of the conveyor belt 31 is conveyed toward another side of the paper conveying direction P, while being suctioned to the conveyance face 31A by the suction force. Ink is ejected from the recording heads 22 of the recording unit 20 (described later) toward the paper T, which is conveyed while being suctioned to the conveyance face 31A by the suction force. In this manner, an image and the like are recorded (printed) on the paper T.

As shown in FIG. 1, the paper feeding cassette 3 accommodates sheets of paper T in a stacked state. The paper feeding cassette 3 is disposed in a lower part of the main body 2 and on an upstream side of the paper conveying direction P of the conveyance unit 30. The paper feeding roller 4 is disposed above the paper feeding cassette 3. When feeding the paper, the paper feeding roller 4 is brought into contact with an uppermost paper T accommodated in the paper feeding cassette 3. The paper feeding roller 4 feeds the uppermost paper T toward an upper right side with respect to the paper feeding cassette 3 in FIG. 1.

The paper conveying path 5, the resist roller pair 6, the recording unit 20 and the conveyance unit 30 are disposed downstream in the paper conveying direction P viewed from the paper feeding cassette 3. The paper T fed out from the paper feeding cassette 3 passes through the paper conveying path 5 and reaches the resist roller pair 6. The resist roller pair 6 temporarily stops the paper T for correcting a skew of the paper T and then feeds again the paper T. A paper front end detection sensor (not shown) provided in the paper conveying path 5 between the recording unit 20 and the resist roller pair 6 detects a front end of the paper T. The recording unit 20 performs ink ejection (described later) based on timing of detection of the front end of the paper T.

As shown in FIG. 1, the drying device 7 is disposed in an upper part of the main body 2 and downstream in the paper conveying direction P viewed from the conveyance unit 30. After recording with the ink ejected in the recording unit 20, the drying device 7 dries the ink on the paper T.

The paper discharging roller pair 8, the paper discharging opening 9 and the discharged paper tray 10 are disposed in this order downstream in the paper conveying direction P viewed from the drying device 7. After drying of the ink is completed by the drying device 7, the paper T is conveyed downstream in the paper conveying direction P by the paper discharging roller pair 8. Subsequently, the paper T is conveyed to the discharged paper tray 10 provided outside the main body 2 via the paper discharging opening 9 and discharged outside the main body 2.

As shown in FIGS. 1 to 3B, the recording unit 20 is provided with the recording heads 22 corresponding to four colors. The recording heads 22 corresponding to four colors each include a recording head 22K for black, recording head 22C for cyan, recording head 22M for magenta, and recording head 22Y for yellow. The recording heads 22K, 22C, 22M and 22Y of the four colors extend in a paper width direction Y that is orthogonal to the paper conveying direction P (the horizontal direction X). The recording heads 22K, 22C, 22M and 22Y are disposed in this order along the paper conveying direction P of the conveyor belt 31, from upstream to downstream in the paper conveying direction P. It should be noted that the recording heads 22K, 22C, 22M and 22Y are fixed to a housing (not shown) of the inkjet recording apparatus 1. In the first embodiment, three recording heads are arranged in series at equal intervals in the paper width direction Y for each of the recording heads 22K, 22C, 22M and 22Y.

As shown in FIG. 1, four ink tanks 23K, 23C, 23M and 23Y corresponding to the recording heads 22K, 22C, 22M and 22Y of the four colors are disposed below the conveyance unit 30. Inks of four colors are supplied from the four ink tanks 23K, 23C, 23M and 23Y to the recording heads 22K, 22C, 22M and 22Y via feeding tubes (not shown), respectively.

It should be noted that, in the following description, reference symbols K, C, M and Y in the recording heads 22K, 22C, 22M and 22Y of the four colors and the four ink tanks 23K, 23C, 23M and 23Y are omitted unless required for identification, and the recording heads and the ink tanks are simply referred to as "a recording head 22" and "an ink tank 23."

The recording heads 22 in the recording unit 20 respectively eject inks of four colors toward the paper T, which is conveyed with the conveyor belt 31 while being suctioned to the conveyance face 31A of the conveyor belt 31, according to the information related to image data (such as a character, a diagram and a pattern) received from an external computer (not shown). As shown in FIGS. 2A to 3B, each of the recording heads 22 is supported by a recording head supporting member 21 of a rectangular plate shape and fixed to the main body 2 along with the recording head supporting member 21. Along with the rotational movement of the conveyor belt 31, the inks of four colors are sequentially ejected from the recording heads 22 at predetermined timing after detection of a front end of the paper T by the paper front end detection sensor. As a result, the inks of black, cyan, magenta and yellow are overlapped on the paper T, thereby printing a color ink image on the paper T.

As an ink ejection method of the recording heads 22, various ejection methods such as a piezoelectric method and a thermal inkjet method may be adopted. The piezoelectric method employs a piezoelectric element (not shown) to force out ink. The thermal inkjet method utilizes a heating element (not shown) to generate air bubbles so as to apply pressure to the ink to be ejected.

As shown in FIG. 1, the vertical movement device 40 of the conveyance unit 30 is disposed below the conveyance unit 30 in contact with a lower face of the conveyance unit 30. The vertical movement device 40 lifts and lowers (moves) the conveyance unit 30 with respect to the recording heads 22 in a direction Z (hereinafter also referred to as "a vertical direction Z") that is vertical to the horizontal plane (X-Y plane). With the movement of the conveyance unit 30 performed by the vertical movement device 40 in the vertical direction Z, the conveyance face 31A of the conveyor belt 31 can relatively move close to and away from nozzle faces 221 (see FIG. 9A) of the recording heads 22.

As shown in FIG. 1, the vertical movement device 40 is provided with eccentric cams 41. The eccentric cams 41 are disposed below the conveyor belt 31, and upstream and downstream in the paper conveying direction P, respectively. Two eccentric cams 41 are disposed on each of the front and back sides of the conveyance unit 30: that is to say, four eccentric cams in total are disposed. An eccentric peripheral surface of each eccentric cam 41 contacts an outer bottom face of the conveyance unit 30 from a lower side thereof, via bearings 43 (described later). As shown in FIG. 1, each eccentric cam 41 includes an axis portion 42 that extends in the paper width direction Y and a cam having an eccentrically positioned rotational axis line. The eccentric cams 41 are rotated about axis portions 42 via a motor (not shown). Each eccentric cam 41 includes the bearings 43 in a peripheral portion thereof. A portion of a peripheral surface of each bearing 43 projects outward from a peripheral surface of each eccentric cam 41.

Each bearing 43 is supported rotatable about an axis line parallel to the rotational axis line of each eccentric cam 41. The bearings 43 are disposed sequentially from a front end to the rotational axis line of each eccentric cam 41. In a normal printing state, a bearing 43 that is the farthest from the axis portion 42 contacts the outer bottom face of the conveyance unit 30 from the lower side thereof, as shown in FIG. 1. Accordingly, the conveyance unit 30 is located at the highest position in the direction Z.

From this position, the eccentric cams 41 on the upstream side in the paper conveying direction P are rotated in a counter-clockwise direction and the eccentric cams 41 on the downstream side in the paper conveying direction P are rotated in a clockwise direction, as viewed from front. In this manner, the bearings 43 sequentially contact the outer bottom face of the conveyance unit 30 in the order from a furthest bearing 43 to a closest bearing 43 with respect to the axis portion 42. Accordingly, the conveyance unit 30 can be lowered.

The bearings 43 are disposed at such intervals that there is a time period where two adjacent bearings 43 in a peripheral direction contact the outer bottom face of the conveyance unit 30 simultaneously while the eccentric cams 41 rotate.

When the conveyance unit 30 is lowered by rotation of the eccentric cams 41 of the vertical movement device 40, the conveying face 31A of the conveyor belt 31 in the conveyance unit 30 is moved downward, away from the recording heads 22. Accordingly, the cap unit 50 is separated from the recording heads 22, as described later. It is possible to perform the ejection recovery processing (purge) for eliminating ink clogging during the cap unit 50 being separated from the recording heads 22. The recovery processing causes the ink supposed to be high in viscosity as result of remaining in the nozzles and the like to be discharged from the inkjet nozzles (not shown) of the recording heads 22. If the ink of high viscosity is used for image formation, an ink ejection defect may occur. When the ink ejection defect occurs, an image defect may occur such as the degraded image density in an image formed on the paper T.

On the other hand, with lifting of the conveyance unit 30 by rotation of the eccentric cams 41 of the vertical movement device 40 in an opposite direction to the abovementioned direction, the conveyance unit 30 is restored to a normal recording position (printing position). This allows printing on the paper T that is conveyed while being suctioned to the conveyor belt 31 of the conveyance unit 30.

As shown in FIGS. 2A to 4B, the cap unit 50 is configured to be disposed below the recording unit 20. The cap unit 50 is provided with: caps 51 as the first ink receiving members; cap cases 52 as the second ink receiving members; and cap base members 53. The cap unit 50 is configured to be movable horizontally in the paper conveying direction P by the horizontal movement mechanism 60 (see FIGS. 4A and 4B). The cap unit 50 is disposed above the conveyance unit 30 and configured to be movable up and down along with the conveyance unit 30 by the vertical movement device 40.

Next, the cap unit 50 and the horizontal movement mechanism 60 are described with reference to FIGS. 4A and 4B.

As shown in FIGS. 4A and 4B, the cap base members 53 of the cap unit 50 are disposed along the paper conveying direction P and connected to both sides of the cap cases 52 in the longitudinal direction (paper width direction) Y.

The horizontal movement mechanism 60 is provided with: a pair of drive pulleys 61; a pair of driven pulleys 62; a pair of drive belts 63; and a drive motor 64.

The pair of drive pulleys 61 is disposed more upstream than the cap base members 53 in the paper conveying direction P. The pair of driven pulleys 62 is disposed more downstream than the cap base members 53 in the paper conveying direction P. A drive belt 63 is wound on a drive pulley 61 and a driven pulley 62. The pair of drive belts 63 is disposed to interpose the pair of cap base members 53 on both sides in the paper width direction Y.

As shown in FIGS. 4A and 4B, the pair of drive pulleys 61 is disposed to be spaced apart from each other in the paper width direction Y and fixed to a drive shaft 65 connected to the drive motor 64. The pair of driven pulleys 62 is disposed to be spaced apart from each other in the paper width direction Y and fixed to a driven shaft 66.

The drive motor 64 is rotatable both in forward and reverse directions. Both end portions of the cap base members 53 disposed in the paper conveying direction P are fixed to the pair of drive belts 63 via fixing members 67. Accordingly, the cap unit 50 including the cap base members 53 can be moved integrally with the pair of drive belts 63 in the paper conveying direction P and an opposite direction thereto. It should be noted that the drive shaft 65 and the driven shaft 66 are rotatably supported in the vicinity of both end portions thereof by side plates (not shown) of the conveyance unit 30.

With the abovementioned configuration, when the drive motor 64 drives the drive shaft 65 to rotate in a clockwise direction in FIG. 4B, the pair of drive belts 63 rotationally moves in the clockwise direction. This causes the cap unit 50 to move horizontally toward downstream in the paper conveying direction P. On the other hand, when the drive motor 64 drives the drive shaft 65 to rotate in a counterclockwise direction in FIG. 4B, the pair of drive belts 63 rotationally moves in the counter-clockwise direction. This causes the cap unit 50 to move horizontally toward upstream in the paper conveying direction P.

Before the cap unit 50 is attached to the recording heads 22, the cap unit 50 is positioned at an attachment/detachment position (which is a position in the paper conveying direction) below the recording heads 22, as shown in FIGS. 2A, 2B, 5 and 6. In addition, at the attachment/detachment position, the cap unit 50 can move vertically between where the caps 51 cover the nozzle faces 221 of the recording heads 22 (see FIG. 5) and where the caps 51 are spaced away from the nozzle faces 221 (see FIG. 6).

On the other hand, at the time of recording (when ink is ejected toward the paper T from the inkjet nozzles of the recording heads 22), the cap unit 50 is positioned at a waiting position (which is a position in the paper conveying direction), as shown in FIGS. 3A, 3B, 7 and 8. The waiting position indicates a position where ejection of ink toward the paper T from the inkjet nozzles of the recording heads 22 is not blocked by the caps 51.

The waiting position is set such that the caps 51 are positioned between one recording head 22 corresponding to the caps 51 and an adjacent recording head 22 disposed downstream in the paper conveying direction P. More specifically, as shown in FIGS. 3A, 3B, 7 and 8, the waiting position is set such that: the caps 51 corresponding to recording heads 22K are positioned between the recording heads 22K and recording heads 22C; the caps 51 corresponding to the recording heads 22C are positioned between the recording heads 22C and recording heads 22M; and the caps 51 corresponding to the recording heads 22M are positioned between the recording heads 22M and recording heads 22Y.

In addition, when the cap unit 50 is moved to the waiting position, as shown in FIGS. 3A, 3B, 7 and 8, the caps 51 corresponding to the recording heads 22Y, which are disposed the most downstream in the paper conveying direction P, are positioned on the downstream side of the recording heads 22Y. With setting the waiting position of the cap unit 50 to be such that each cap 51 is positioned between an adjacent pair of recording heads 22, it is possible to reduce a distance of movement of the cap unit 50 between the waiting position and the attachment/detachment position.

In addition, when the ejection recovery processing (purge) is performed, the cap unit 50 is lowered by the vertical movement device 40 (see FIG. 1) at the waiting position, and then moved to the attachment/detachment position by the horizontal movement mechanism 60 (see FIGS. 4A and 4B). Alternatively, the cap unit 50 is lowered by the vertical movement device 40 at the attachment/detachment position. This allows for the ejection recovery processing.

Next, the movement of the cap unit 50 is described with reference to FIGS. 5 to 8. As shown in FIG. 5, when printing is not performed for a long period of time, for example, the cap unit 50 is attached to the recording heads 22 at the attachment/detachment position. Additionally, the caps 51 cover the nozzle faces 221 of the recording heads 22. As a result, an ink ejection defect in image formation due to dried ink in the nozzles and the like, and an intrusion of foreign matters into the recording heads 22 via the nozzles can be prevented while the recording heads 22 are not in use.

Prior to the next recording, as shown in FIG. 6, the vertical movement device 40 (see FIG. 1) lowers the cap unit 50 along with the conveyance unit 30 in order to separate the caps 51 from the nozzle faces 221 of the recording heads 22. In other words, the vertical movement device 40 causes the caps 51 to move downward such that the caps 51 are spaced apart from the nozzle faces 221 of the recording heads 22. Under such a situation, discharging ink from the inkjet nozzles (not shown) of the recording heads 22 enables the ejection recovery processing for preventing the ink ejection defect. As a result of a long time period of nonuse of the recording unit 20, the viscosity of ink remaining inside the nozzles may be high. If ink of high viscosity is used for image formation, an ink ejection defect may occur. When the ink ejection defect occurs, an image defect occurs such as degraded image density in an image formed on the paper T. Accordingly, such ink is discharged from the nozzles, thereby preventing the ink ejection defect.

After the ejection recovery processing, as shown in FIG. 7, the cap unit 50 is horizontally moved from the attachment/detachment position shown in FIGS. 5 and 6 to the downstream side in the paper conveying direction P (a thick arrow direction in FIG. 7) by the horizontal movement mechanism 60 (see FIGS. 4A and 4B). More specifically, the caps 51 of the cap unit 50 are horizontally moved to the waiting position where the caps 51 do not block the ink ejection toward the paper T from the inkjet nozzles of the recording heads 22.

Subsequently, while the cap unit 50 is in the waiting position, the vertical movement device 40 lifts the cap unit 50 along with the conveyance unit 30 as shown in FIG. 8. As a result, the recording head 22s face the conveyance face 31A of the conveyor belt 31 in the conveyance unit 30, maintaining a predetermined distance (1 mm in the present embodiment). While an image is formed on the paper T, inks of four colors are ejected from inkjet nozzles of the recording heads 22 toward the paper T, which is conveyed by the conveyance belt 31 (see FIG. 1). As a result, the inks of black, cyan, magenta and yellow are overlapped on the paper T to produce printing (recording) of a color ink image on the paper T.

Features of the inkjet recording apparatus 1 according to the first embodiment are described with reference to FIGS. 9A to 11B.

Figure 9A:
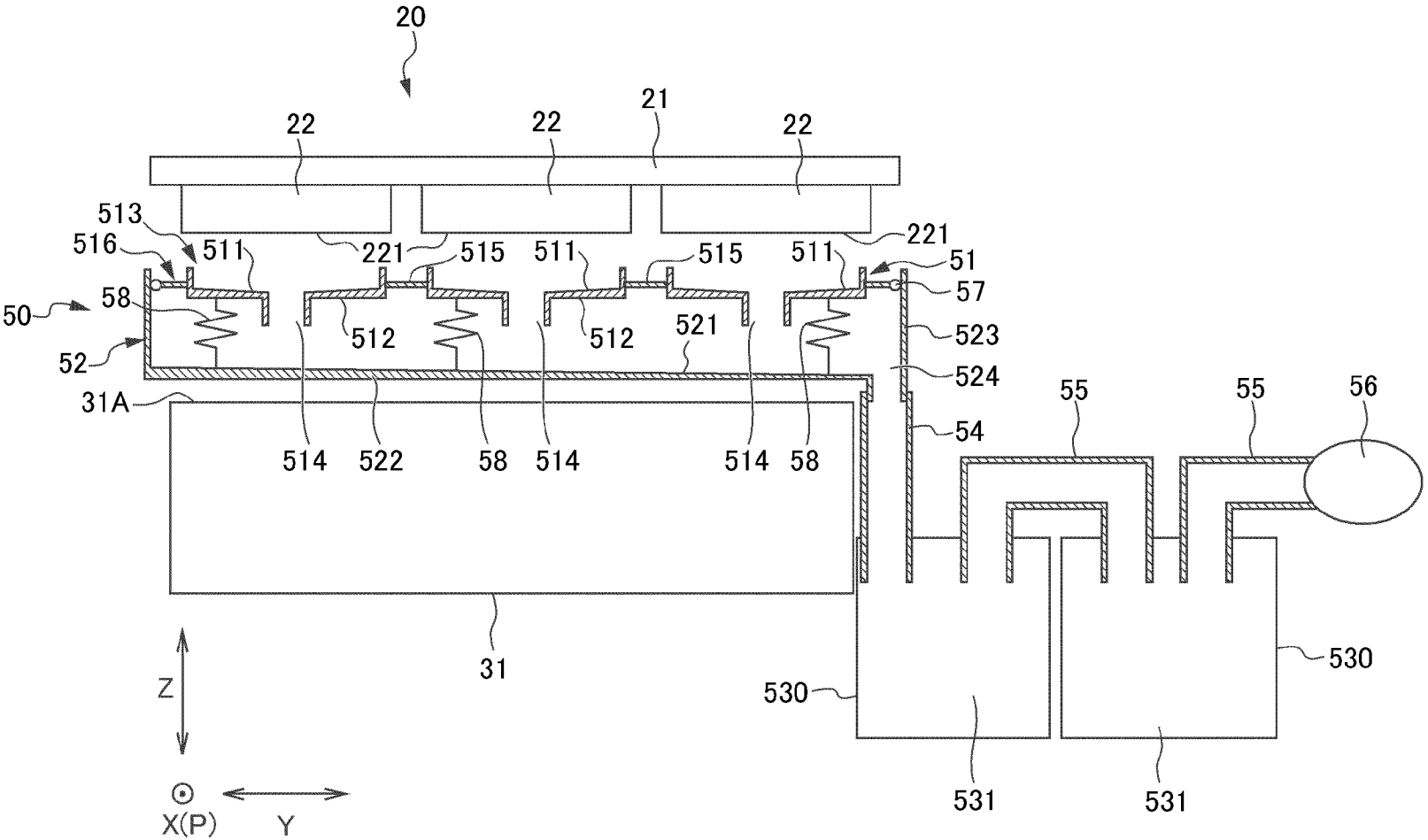
FIG. 9A is a vertical cross-sectional view showing the overall structure of the cap unit from a right side.
Figure 9B:
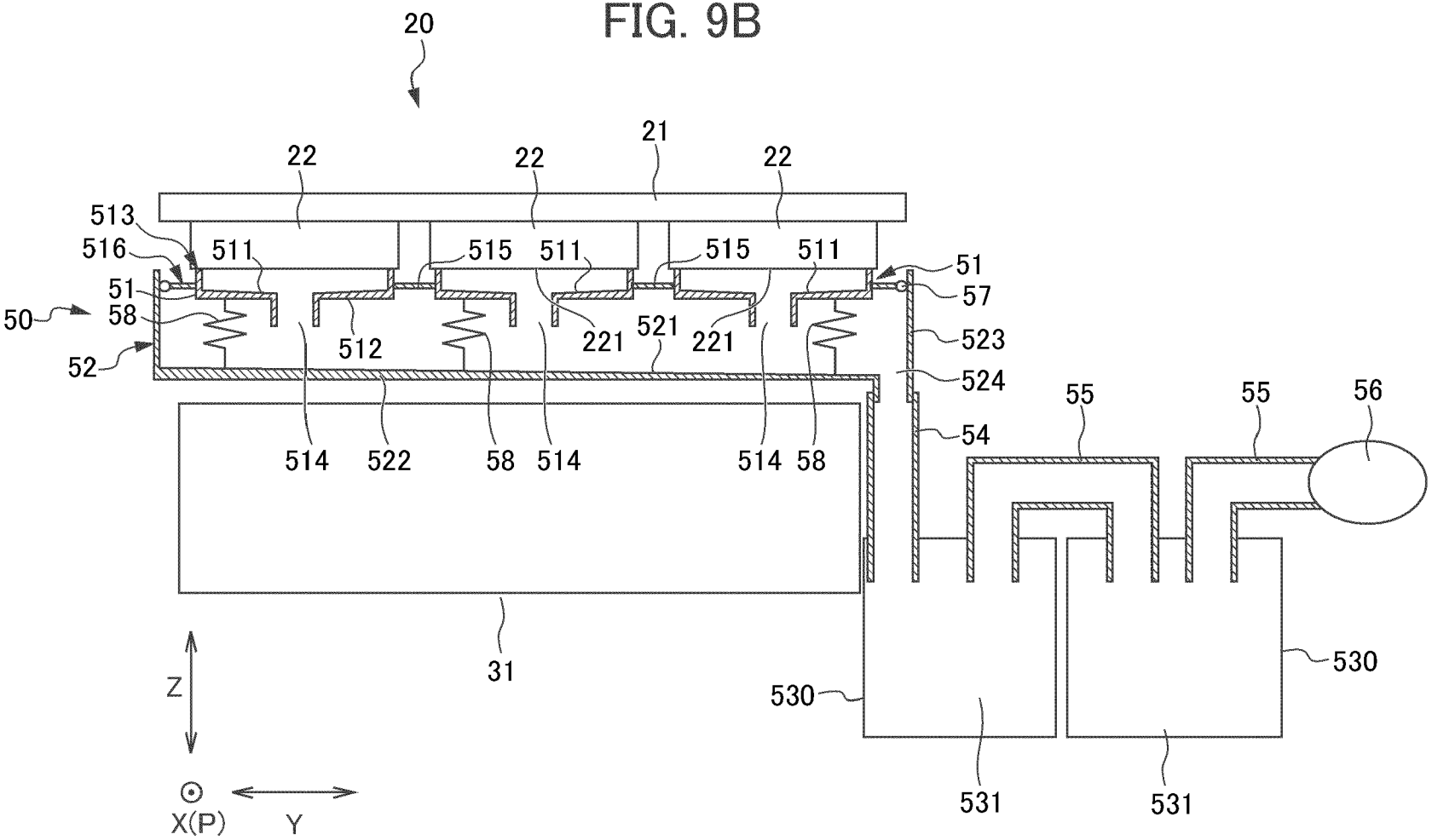
FIG. 9B is a vertical cross-sectional view showing the cap unit having been attached to the recording heads, while changing from the state shown in FIG. 9A.
Figure 9C:
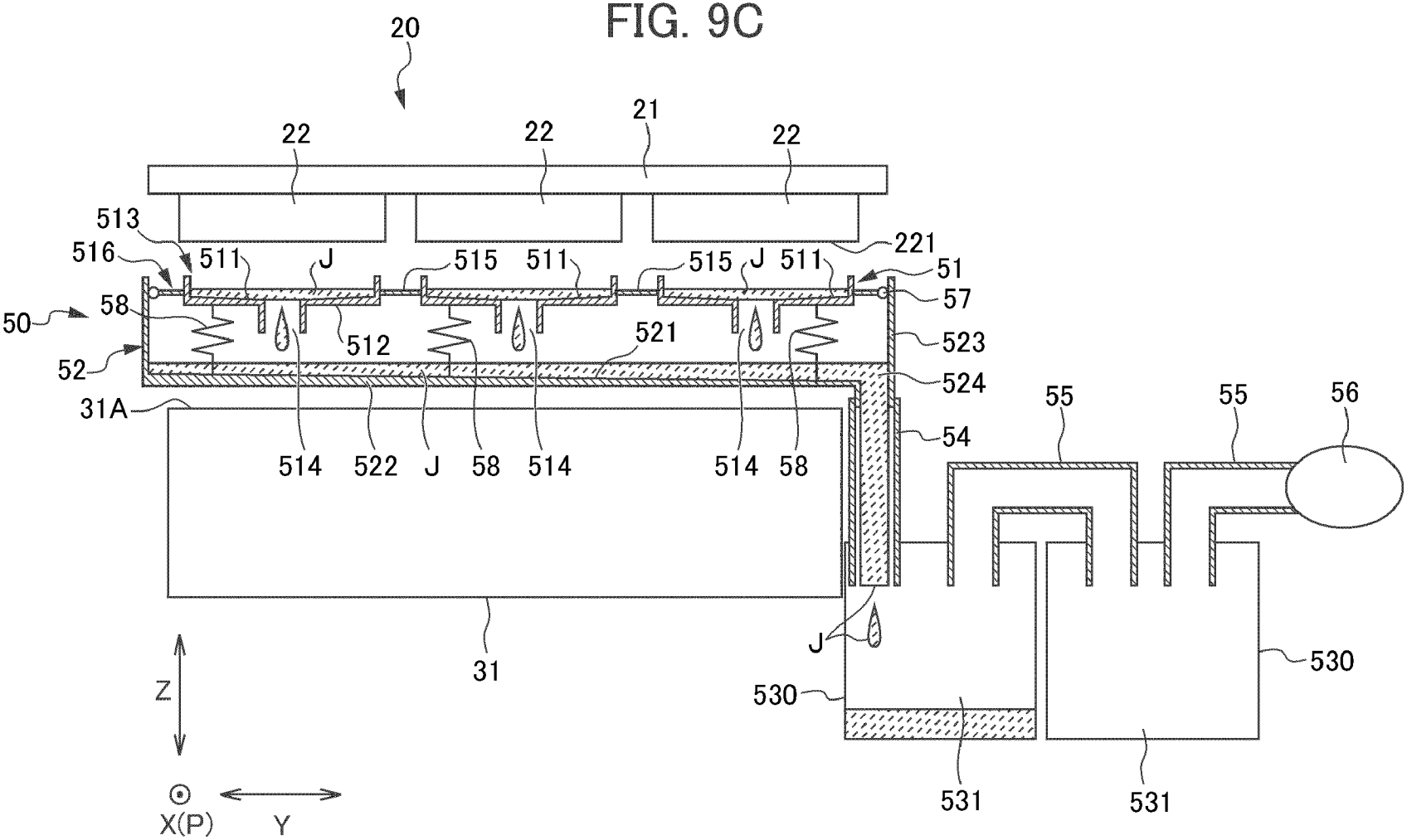
FIG. 9C is a vertical cross-sectional view showing a flow and a collection process of ink discharged from inkjet nozzles of the recording heads in recovery processing by discharging.
Figure 10A:
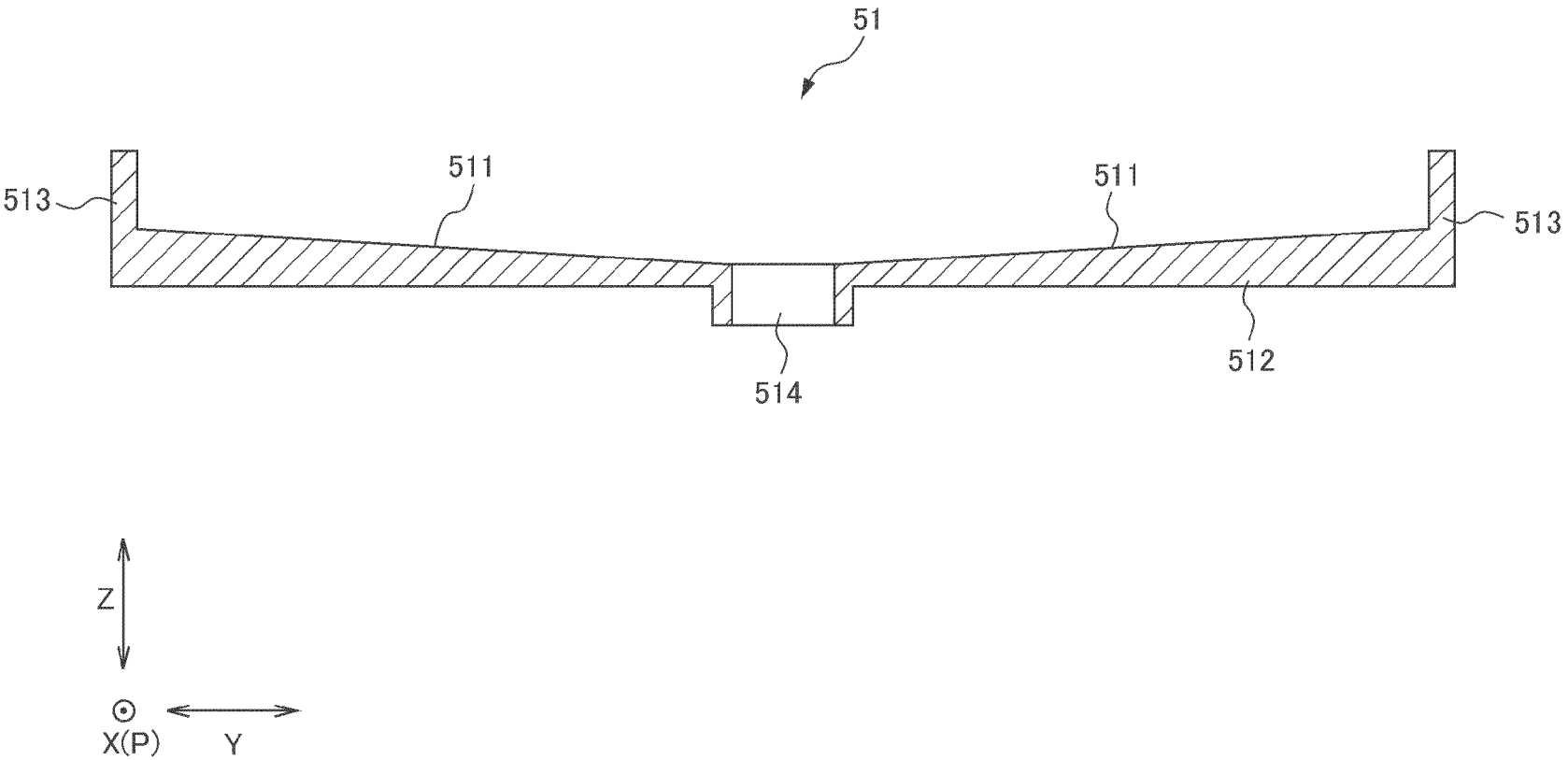
FIG. 10A is an enlarged vertical cross-sectional view showing a cap of the cap unit from a right side.
Figure 10B:
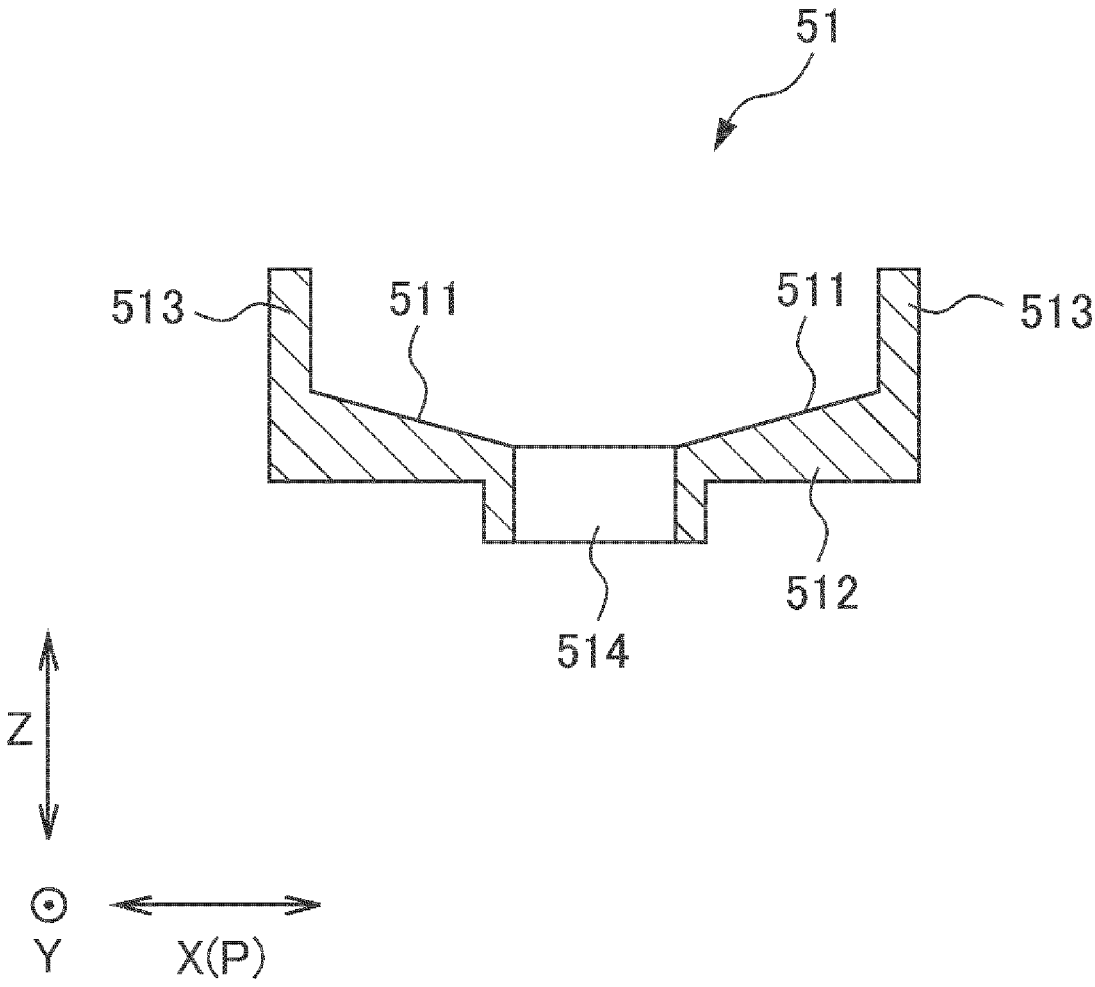
FIG. 10B is a vertical cross-sectional view showing the cap shown in FIG. 10A from a front side.
Figure 11A:
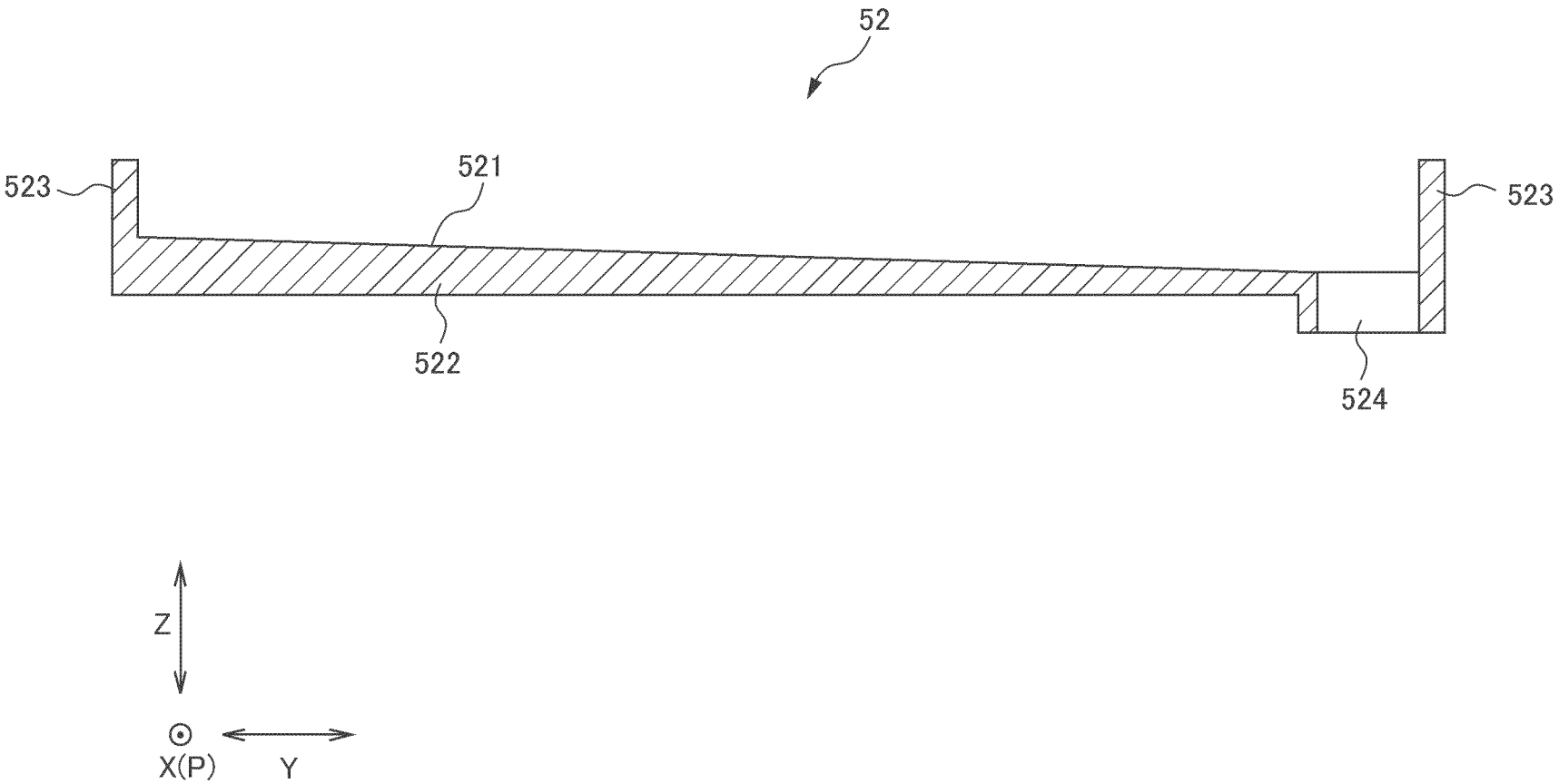
FIG. 11A is an enlarged vertical cross-sectional view showing a cap case of the cap unit from a right side.
Figure 11B:
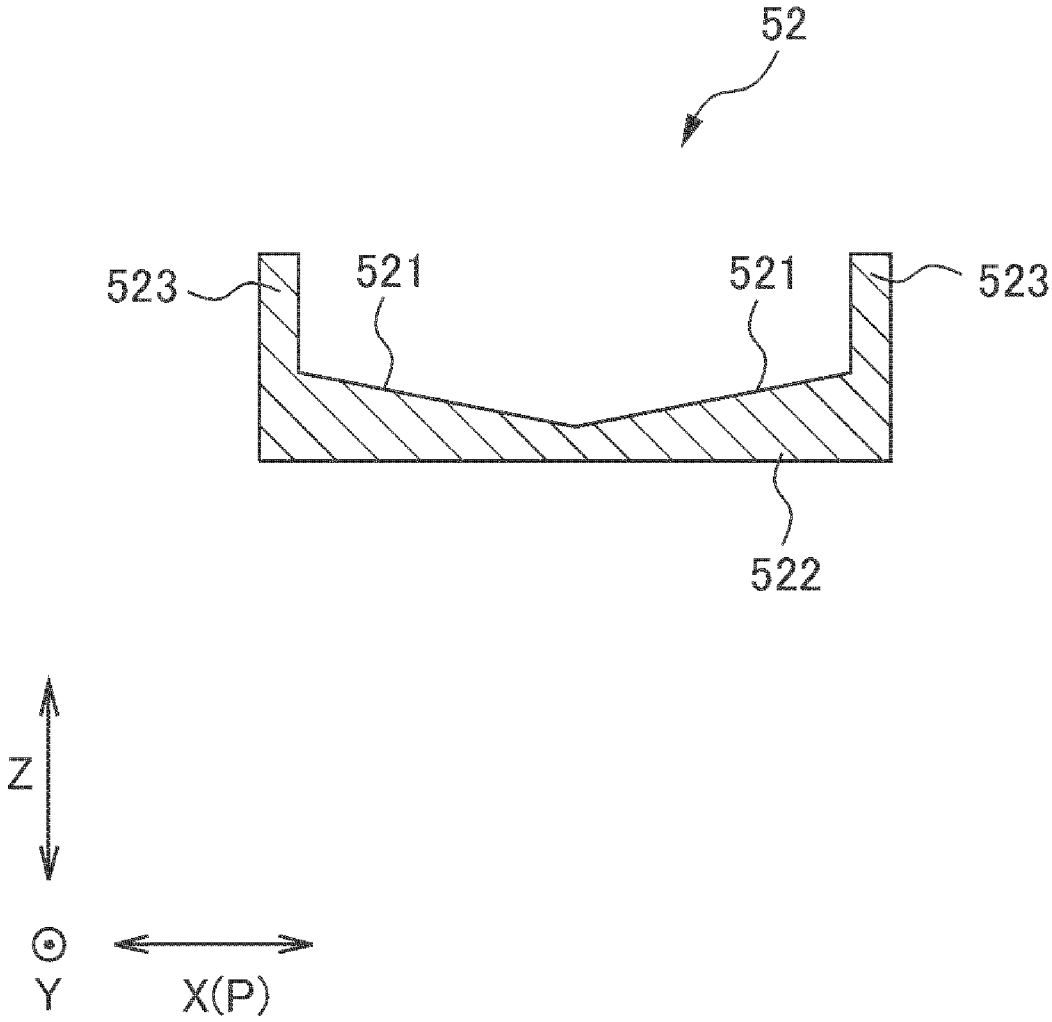
FIG. 11B is a vertical cross-sectional view showing the cap case shown in FIG. 11A from a front side.

FIG. 9A is a vertical cross-sectional view showing an overall structure of the cap unit 50 from a right side. FIG. 9B is a vertical cross-sectional view showing the cap unit 50 being attached to the recording heads 22, which differs from the state shown in FIG. 9A. FIG. 9C is a vertical cross-sectional view showing a flow and a collection process of ink discharged from inkjet nozzles of the recording heads 22 in ejection recovery processing. FIG. 10A is an enlarged vertical cross-sectional view showing a cap 51 of the cap unit 50 from a right side. FIG. 10B is a vertical cross-sectional view showing the cap 51 shown in FIG. 10A from a front side. FIG. 11A is an enlarged vertical cross-sectional view showing a cap case 52 of the cap unit 50 from a right side. FIG. 11B is a vertical cross-sectional view showing the cap case 52 shown in FIG. 11A from a front side.

As shown in FIGS. 9A to 9C, the cap unit 50 is provided with: the caps 51; the cap case 52; waste ink containers 530; a tube 54 as the communicating member; and a pump 56 for ink collection.

In the following description, only caps 51 corresponding to one of the four colors are described.

Three caps 51 are provided so as to respectively correspond to the three recording heads 22, and configured to be movable below the recording heads 22. One cap case 52 is disposed below and corresponding to the three caps 51. The waste ink containers 530 are disposed on an end side in the paper width direction Y of the conveyance belt 31 of the conveyance unit 30 (behind the conveyance unit 30 in FIG. 1). The tube 54 communicatively connects a second discharging hole 524 (described later) of the cap case 52 with an ink storage chamber 531 of a waste ink container 530. The tube 54 has a length to cope with the movement of the cap unit 50. The waste ink containers 530 are disposed in series. The waste ink containers 530 are communicatively connected with each other via an ink collection tube 55 and accumulate (store) ink one after another. The pump 56 is connected to one end of the ink collection tube 55.

As shown in FIGS. 9A to 10B, each of the caps 51 includes: a first bottom wall portion 512 in which a first bottom face 511 as the first receiving portion is formed; a first peripheral wall portion 513; and a first discharging hole 514.

The first bottom face 511 acts as the first receiving portion that receives ink J that is discharged from the inkjet nozzles (not shown) of the recording head 22. The first peripheral wall portion 513 stands up from a peripheral portion of the first bottom wall portion 512. The first discharging hole 514 is formed at a central position of the first bottom face 511 and discharges downwards the ink J received by the first bottom face 511.

As shown in FIGS. 10A and 10B, the first bottom face 511 of each of the caps 51 is configured to incline downwards from the first peripheral wall portion 513 toward the first discharging hole 514. In addition, as shown in FIGS. 9A to 10B, outer faces of the first peripheral wall portion 513 are connected via a connection plate 515, the three caps 51 are configured to integrate into a first cap unit 516. Furthermore, the three caps 51 are fitted in three apertures formed in the connection plate 515, so that the caps 51 and the connection plate 515 are integrated with each other. The first cap unit 516 may also be integrally formed with plastics.

As shown in FIGS. 9A, 9B, 9C, 11A and 11B, the cap case 52 includes: a second bottom wall portion 522 in which a second bottom face 521 as the second receiving portion is formed; a second peripheral wall portion 523; a second discharging hole 524; and compression springs 58 as biasing members. The second bottom face 521 acts as the second receiving portion that collectively receives the ink J that is discharged from first discharging holes 514 of the three caps 51. The second peripheral wall portion 523 stands up from a peripheral portion of the second bottom wall portion 522. The second discharging hole 524 is formed in the vicinity of an end portion in a longitudinal direction (paper width direction Y) of the second bottom wall portion 522. The second discharging hole 524 discharges downwards the ink J discharged from each of the first discharging holes 514 and received by the second bottom face 521.

As shown in FIG. 11A, the second bottom face 521 of the cap case 52 is configured to incline downwards toward the second discharging hole 524, as viewed from the paper conveying direction P. In addition, as shown in FIG. 11B, the second bottom face 521 of the cap case 52 is configured to incline downwards from each of a pair of parts of the second peripheral wall portion 523, the pair of parts facing each other in the paper conveying direction P, toward a central portion in the paper conveying direction P, as viewed from the paper width direction Y.

In addition, as shown in FIGS. 9A to 9C, a seal 57 is disposed between an outer peripheral portion of the connection plate 515 of the first cap unit 516 and an inner face of the second peripheral wall portion 523 of the cap case 52. Accordingly, a sealing portion is formed. The outer peripheral portion of the first cap unit 516 is hermetically attached to the inner face of the second peripheral wall portion 523 of the cap case 52 via the seal 57. Accordingly, since an airflow between the first cap unit 516 and the cap case 52 is blocked, it is possible to discharge the ink J smoothly.

As shown in FIG. 9A to 9C, one end portion (upper end portion) of the tube 54 is connected to the second discharging hole 524 of the cap case 52. Another end portion (lower end portion) of the tube 54 opens into the ink storage chamber 531 of the waste ink container 530. In this manner, the ink J that is collectively received by the second bottom face 521 of the cap case 52 and collectively discharged from the second discharging hole 524 can be guided into the inside of the ink storage chamber 531 of the waste ink container 530 only by the tube 54 and accumulated in the ink storage chamber 531.

In addition, as shown in FIGS. 9A to 9C, a compression spring 58 is disposed between a lower face of the first bottom wall portion 512 of each of the caps 51 in the first cap unit 516 and an upper face (the second bottom face 521) of the second bottom wall portion 522 of the cap case 52. As shown in FIG. 9B, when the cap unit 50 is lifted by the vertical movement device 40 toward the recording heads 22 along with the conveyance unit 30 and each of the caps 51 covers the nozzle face 221 of the corresponding recording head 22, the compression spring 58 biases to press elastically each of the caps 51 against the corresponding nozzle face 221.

Next, the operation of the cap unit 50 in the inkjet recording apparatus 1 according to the first embodiment is described with reference to FIGS. 5, 6, 9B and 9C.

As shown in FIG. 5, when the recording heads 22 are not in use (in a case where recording is not performed for over a predetermined amount of time), the cap unit 50 is moved to the attachment/detachment position by the horizontal movement mechanism 60 (see FIGS. 4A and 4B). Subsequently, at the attachment/detachment position, the cap unit 50 is lifted along with the conveyance unit 30 by the vertical movement device 40 (see FIG. 1) and attached to the recording heads 22.

When the cap unit 50 is attached to the recording heads 22, as shown in FIG. 9B, each of the caps 51 of the cap unit 50 covers the nozzle face 221 of the corresponding recording head 22. As a result of each of the caps 51 receiving an elastic force by the compression spring 58 under the situation described above, an upper end portion of the first peripheral wall portion 513 elastically comes into tight contact with the nozzle face 221 of the corresponding recording head 22 (a peripheral portion of the nozzle face 221 without the inkjet nozzles). Accordingly, clogging of the nozzles due to dried ink in the nozzles and the like, and the intrusion of foreign matters into the recording heads 22 via the nozzles can be prevented while the recording heads 22 are not in use.

Prior to the next recording by the recording heads 22, as shown in FIG. 6, the vertical movement device 40 lowers the cap unit 50 along with the conveyance unit 30 such that the caps 51 are moved downward to be separated from the nozzle faces 221 of the recording heads 22.

When the cap unit 50 is thus lowered below the recording heads 22, as shown in FIG. 9C, each of the caps 51 of the cap unit 50 is disposed directly under the nozzle face 221 of the corresponding recording head 22. Under such a situation, the ejection recovery processing is performed through discharging ink from the inkjet nozzles (not shown) of each of the recording heads 22. The ejection recovery processing is to discharge ink remaining in the nozzles and the like, which can be high in viscosity as a result of a long time period of nonuse of the recording unit 20 (the recording heads 22 unused over a predetermined amount of time), such that an ink ejection defect in image formation is prevented.

As shown in FIG. 9C, with the ejection recovery processing, the ink J discharged from the inkjet nozzles of each of the recording heads 22 is received by the first bottom face 511 of each of the caps 51, and merges and flows toward the first discharging hole 514 along a slope of the first bottom face 511. Thereafter, the merged ink J is discharged downwards from the first discharging hole 514 of each of the caps 51.

The ink J discharged downwards from the first discharging holes 514 of each of the caps 51 is collectively received by the second bottom face 521 of the cap case 52, and merges and flows along a slope of the second bottom face 521 toward one end portion in a longitudinal direction of the cap case 52 to the second discharging hole 524. Thereafter, the merged ink J is discharged from the second discharging hole 524. The ink J discharged from the second discharging hole 524 runs through the single tube 54 and is stored (accumulated) in the ink storage chamber 531 of the waste ink container 530.

The ink J stored in the waste ink container 530 is collected through the ink collection tube 55 to a predetermined location (not shown).

After the completion of the ejection recovery processing, as shown in FIG. 7, the cap unit 50 is moved to the waiting position by the horizontal movement mechanism 60. Subsequently, as shown in FIG. 8, the cap unit 50 is lifted along with the conveyance unit 30 by the vertical movement device 40 at the waiting position. Each of the caps 51 lifted at the waiting position is positioned between one recording head 22 that is corresponding to each cap 51 and another recording head 22 that is adjacent to the one recording head 22 on the downstream side in the paper conveying direction P. As a result, each of the recording heads 22 is disposed to face the conveyance face 31A of the conveyor belt 31 in the conveyance unit 30, maintaining a predetermined distance (for example, 1 mm).

When an image is formed on the paper T under the situation described above, inks of four colors are ejected from the inkjet nozzles of each of the recording heads 22 toward the paper T, which is conveyed by the conveyance belt 31 (see FIG. 1). As a result, the inks of black, cyan, magenta and yellow are overlapped on the paper T, so that a color ink image is printed (recorded).

As sequentially shown in FIGS. 6, 7 and 8, after the completion of printing (recording), the cap unit 50 is lowered along with the conveyance unit 30 at the waiting position by the vertical movement device 40, horizontally moved back to the attachment/detachment position by the horizontal movement mechanism 60, and, lifted along with the conveyance unit 30 by the vertical movement device 40 at the attachment/detachment position. In this manner, the cap unit 50 is attached to the recording heads 22, as shown in FIG. 5. As a result, as shown in FIG. 9B, each of the caps 51 of the cap unit 50 covers the nozzle face 221 of the corresponding recording head 22. Accordingly, clogging of the nozzles due to dried ink in the nozzles and the like, and the intrusion of foreign matters into the recording heads 22 via the nozzles can be prevented.

According to the first embodiment, the ink J collectively received by the cap case 52 can be introduced into the inside of the ink storage chamber 531 of the waste ink container 530 and accumulated therein using the single tube 54 communicatively connected to the second discharging hole 524. This can reduce the number of tubes 54 since it is not necessary to dispose the same number of tubes 54 as the plurality of recording heads 22. As a result, it is possible to implement a reduced cost and more simplified arrangement of the tube 54, compared to an apparatus using the same number of tubes 54 as the plurality of recording heads 22. The simplified arrangement of the tube 54 can easily realize a configuration in which the ink J flows and drops in the tube 54 by gravity.

In addition, this can simplify a configuration of the horizontal movement mechanism and the like of the cap unit 50 including the plurality of caps 51.

In the first embodiment, the first bottom face 511 of each of the caps 51 and the second bottom face 521 of the cap case 52 are configured to incline downwards toward the first discharging hole 514 and the second discharging hole 524, respectively. Accordingly, the received ink J can be merged and flowed smoothly to the first discharging hole 514 and the second discharging hole 524, by utilizing the gravitational effect of its own weight.

In this manner, it is possible to increase the efficiency of collecting the ink J during the ejection recovery processing, thereby reducing standby time from the ejection recovery processing to a start of recording.

In addition, the cap case 52 according to the first embodiment is provided with the compression springs 58 that elastically bias the caps 51 covering the nozzle faces 221 of the recording heads 22 toward the nozzle faces 221 during the recording heads 22 being not in use.

This allows the first peripheral wall portions 513 of the caps 51 for covering the nozzle faces 221 to be tightly attached to the nozzle faces 221 during the recording heads 22 being not in use. Accordingly, it is possible to better prevent clogging of the nozzles due to dried ink and the intrusion of foreign matters into the recording heads 22 via the nozzles during the recording heads 22 being not in use.

Next, another embodiment of the present invention is described. Regarding the following embodiment, differences from the first embodiment are mainly described, components similar to the first embodiment are referred to by the same symbols and specific descriptions thereof are omitted. The descriptions in the first embodiment are applicable to the components that are not explained in the following embodiment. In addition, the following embodiment provides the same advantages as the first embodiment.

Second Embodiment

Figure 12A:
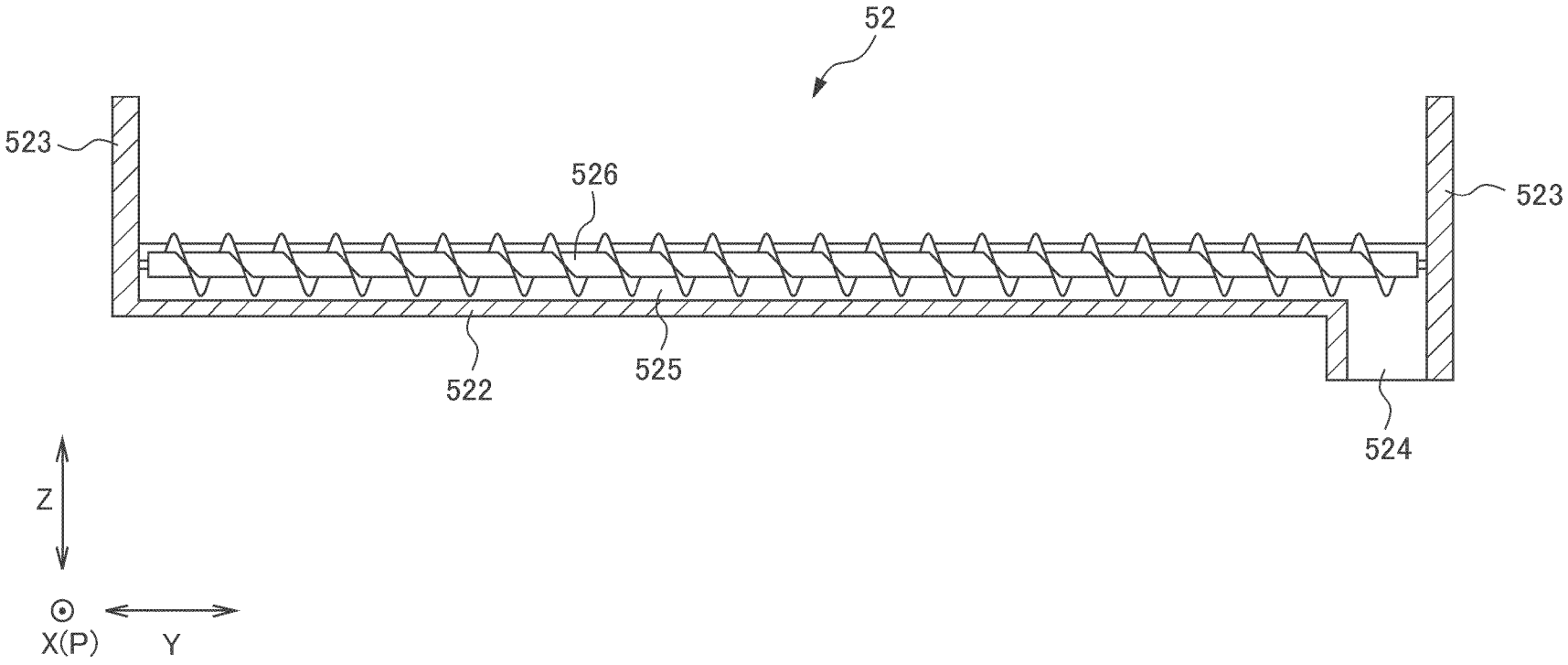
FIG. 12A is an enlarged vertical cross-sectional view showing a cap case of the cap unit according to a second embodiment from a right side.
Figure 12B:
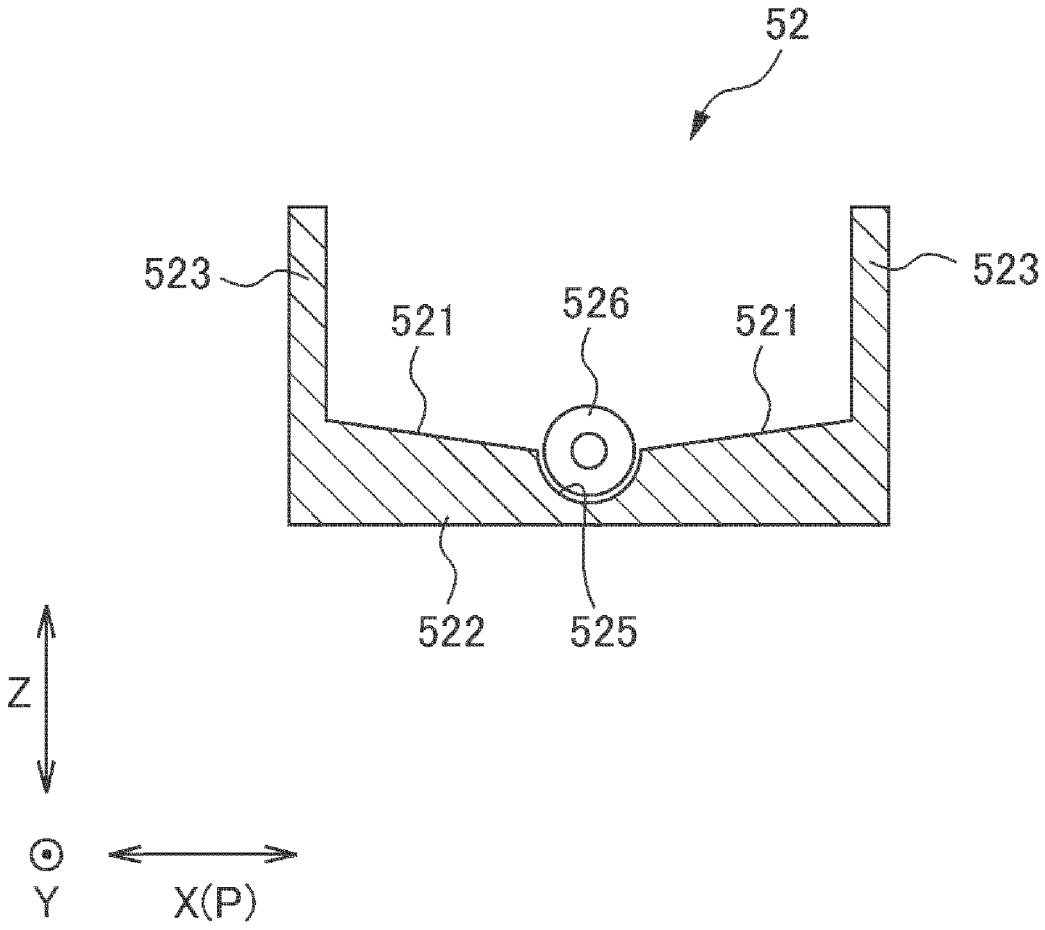
FIG. 12B is a vertical cross-sectional view showing the cap case shown in FIG. 12A from a front side.

A second embodiment is described with reference to FIGS. 12A and 12B. FIG. 12A is an enlarged vertical cross-sectional view from a right side showing a cap case 52 of a cap unit 50 according to the second embodiment. FIG. 12B is a vertical cross-sectional view showing the cap case 52 shown in FIG. 12A from a front side.

As shown in FIGS. 12A and 12B, a second bottom face 521 of the cap case 52 is configured to incline downwards from each of a pair of parts of second peripheral wall portion 523, the pair of parts facing each other in a paper conveying direction P, toward a central portion in the paper conveying direction P when viewed from a paper width direction Y. In a lowermost portion of the second bottom face 521 in the paper conveying direction P, a gutter portion 525 is formed, which is shaped in a concave like a semicircle. The gutter portion 525 extends in the paper width direction Y. An end of the gutter portion 525 opens into a second discharging hole 524.

In addition, a spiral member 526 is rotatably disposed in the gutter portion 525. The spiral member 526 is configured to be rotationally driven via a motor (not shown) at a constant speed. The spiral member 526 displaces and transfers ink J, which is received by the second bottom face 521 and flows into the gutter portion 525, toward the second discharging hole 524. Other features of the second embodiment are the same as the first embodiment.

The second embodiment of the above configuration is provided with the gutter portion 525 in the lowermost portion of the second bottom face 521 of the cap case 52 and the spiral member 526 inside the gutter portion 525 that forcibly displaces and transfers the ink J, which flows into the gutter portion 525 via the second bottom face 521, toward the second discharging hole 524. Accordingly, even if the ink J discharged from first discharging holes 514 of a plurality of caps 51 is high in viscosity, the ink J hardly remains or adheres to the second bottom face 521 of the cap case 52, which receives the ink J. In this manner, it is possible to reliably and smoothly transfer the ink J to the second discharging hole 524 and discharge it therefrom. Therefore, the present embodiment is preferably applicable to processing of the ink J after the ejection recovery processing, which is high in viscosity as a result of recording heads 22 being unused for a long period of time.

A preferred embodiment of the present invention has been described above; however, the present invention is not limited thereto and can be carried out in various modes.

Figure 13:
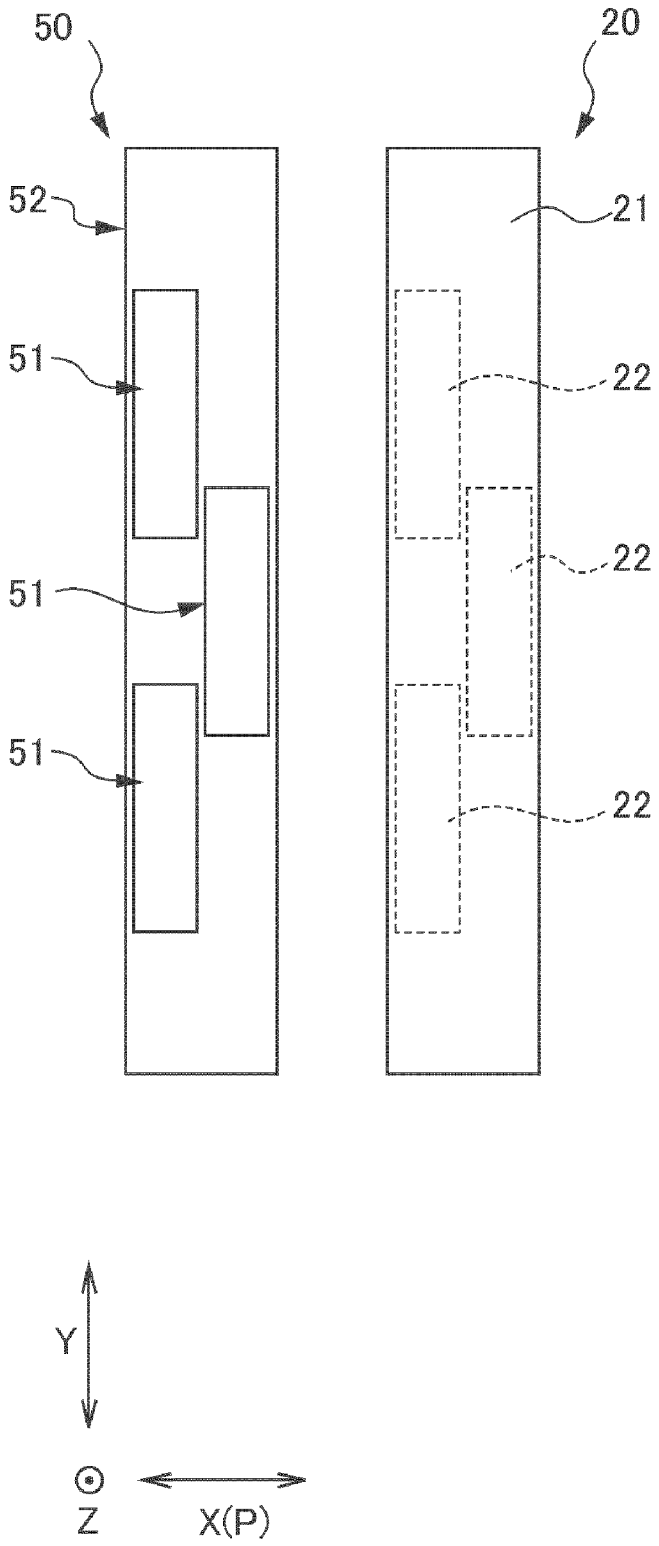
FIG. 13 is a plan view showing a modification of an arrangement of the recording heads and the caps.

For example, although the three recording heads 22 of the recording unit 20 and the three caps 51 of the cap unit 50 are arranged in series at equal intervals in the paper width direction Y in the above embodiments, the present invention is not limited thereto. For example, as shown in FIG. 13, the three recording heads 22 and the three caps 51 can be arranged in a zigzag manner such that one recording head and one cap are configured to be out of line with respect to the other two recording heads and caps in the paper conveying direction P.

A configuration for guiding the ink in the cap 51 to the first discharging hole 514, a configuration for guiding the ink in the cap case 52 to the second discharging hole 524 and the like are not limited.

In addition, although the conveyance face 31A can be moved relatively toward and away from the nozzle faces 221 of the recording heads 22 by lifting and lowering the conveyance unit 30 with respect to the recording heads 22 of the recording unit 20 in the above embodiments, the present invention is not limited thereto. For example, it may be alternatively possible to lift and lower the recording unit 20 without moving the conveyance unit 30 such that the nozzle faces 221 of the recording heads 22 and the conveyance face 31A relatively approach and depart away from each other. It may also be alternatively possible to move both the conveyance unit 30 and the recording unit 20 such that the conveyance face 31A and the nozzle faces 221 of the recording heads 22 relatively approach and depart away from each other.

Furthermore, although a description is omitted in the above embodiments, it may be preferable to adopt a control device such as a computer for the inkjet recording apparatus. For example, the control device includes memory storing a control program that automatically performs in a preset order a series of operations: recording of an image; capping of the nozzle faces 221; and the ejection recovery processing (purge).

The embodiments shown in FIGS. 1 to 12A are provided for confirming the ejection recovery processing. The embodiments relate to an inkjet recording apparatus that conveys three sheets of paper (postcard size) in parallel and simultaneously to perform printing on them. In a case of an inkjet recording apparatus for printing on a sheet of paper of A4 or A3 size, it may be preferable to arrange the recording heads 22 and the caps 51 as shown in FIG. 13.

What is claimed is:

1. An inkjet recording apparatus comprising:

a plurality of recording heads each comprising a nozzle face on which inkjet nozzles are formed;

a cap unit comprising a plurality of first ink receiving members and a second ink receiving member;

each of the first ink receiving members being disposed below and corresponding to each of the recording heads and comprising a first receiving portion that receives ink discharged from the inkjet nozzles and a first discharging hole that discharges the ink received by the first receiving portion; and the second ink receiving member being disposed below and corresponding to the first ink receiving members and comprising a second receiving portion that collectively receives the ink discharged through a plurality of first discharging holes and a second discharging hole that discharges the ink received by the second receiving portion;

a waste ink container comprising an ink storage chamber storing ink discharged through the second discharging hole; and a communicating member that communicatively connects the second discharging hole of the second ink receiving member with the ink storage chamber of the waste ink container.

2. The inkjet recording apparatus according to claim 1, wherein the first receiving portion of each of the first ink receiving members is configured to incline downward toward the first discharging hole.

3. The inkjet recording apparatus according to claim 2, wherein the second receiving portion of the second ink receiving member is configured to incline downward toward the second discharging hole.

4. The inkjet recording apparatus according to claim 3, wherein the plurality of first ink receiving members is configured to integrate into a first ink receiving member unit.

5. The inkjet recording apparatus according to claim 2, wherein the plurality of first ink receiving members is configured to integrate into a first ink receiving member unit.

6. The inkjet recording apparatus according to claim 1, wherein the second receiving portion of the second ink receiving member is configured to incline downward toward the second discharging hole.

7. The inkjet recording apparatus according to claim 6, wherein the plurality of first ink receiving members is configured to integrate into a first ink receiving member unit.

8. The inkjet recording apparatus according to claim 1, wherein the second ink receiving member comprises a spiral member that displaces the ink received by the second receiving portion toward the second discharging hole.

9. The inkjet recording apparatus according to claim 8, wherein the plurality of first ink receiving members is configured to integrate into a first ink receiving member unit.

10. The inkjet recording apparatus according to claim 1, wherein the plurality of first ink receiving members is configured to integrate into a first ink receiving member unit.

11. The inkjet recording apparatus according to claim 10, wherein the second ink receiving member comprises:

a second peripheral wall portion that stands up from a peripheral portion of the second receiving portion; and a sealing portion provided between the first ink receiving members and the second peripheral wall portion such that an airflow between the first ink receiving member unit and the second peripheral wall portion is prevented.

12. The inkjet recording apparatus according to claim 1, wherein each of the first ink receiving members covers the nozzle face when each of the recording heads is not in use; and the second ink receiving member comprises a biasing member that biases each of the first ink receiving members toward the nozzle face when each of the first ink receiving members covers the nozzle face.

13. The inkjet recording apparatus according to claim 1, further comprising a conveyance unit that conveys paper, wherein the cap unit is supported by the conveyance unit.

14. The inkjet recording apparatus according to claim 13, further comprising a horizontal movement mechanism that moves the cap unit, wherein the cap unit can be moved by the horizontal movement mechanism in a paper conveying direction and in a direction opposite thereto.

15. The inkjet recording apparatus according to claim 13, wherein before the plurality of recording heads perform image formation on the paper, the horizontal movement mechanism moves each of the first ink receiving members between one of the recording heads corresponding to the first ink receiving members and an adjacent recording head positioned downstream with respect to the one of the recording heads in the paper conveying direction.

16. The inkjet recording apparatus according to claim 13, further comprising a vertical movement device that vertically moves the conveyance unit, wherein the vertical movement device vertically moves the cap unit along with the conveyance unit with respect to the recording heads.

* * * * *